US009856669B2

(12) United States Patent
Hui et al.

(10) Patent No.: US 9,856,669 B2
(45) Date of Patent: Jan. 2, 2018

(54) ADVANCED POOL CLEANER CONSTRUCTION

(71) Applicants: Wing-Tak Hui, Hong Kong (CN); Andrew Matthew Hui, San Jose, CA (US); Wing-Kin Hui, Hong Kong (CN)

(72) Inventors: Wing-Tak Hui, Hong Kong (CN); Andrew Matthew Hui, San Jose, CA (US); Wing-Kin Hui, Hong Kong (CN)

(73) Assignee: Compurobot Technology Company, Guangdong (CN)

( * ) Notice: Subject to any disclaimer, the term of this patent is extended or adjusted under 35 U.S.C. 154(b) by 0 days.

(21) Appl. No.: 14/571,600

(22) Filed: Dec. 16, 2014

(65) Prior Publication Data

US 2016/0168872 A1 Jun. 16, 2016

Related U.S. Application Data

(63) Continuation-in-part of application No. 14/551,894, filed on Nov. 24, 2014, now Pat. No. 9,366,049.

(51) Int. Cl.
*E04H 4/16* (2006.01)

(52) U.S. Cl.
CPC ..... *E04H 4/1663* (2013.01); *E04H 4/1654* (2013.01)

(58) Field of Classification Search
CPC ..... E04H 4/16; E04H 4/1654
See application file for complete search history.

(56) References Cited

U.S. PATENT DOCUMENTS 3,102,289 A 9/1963 Norris
3,675,261 A * 7/1972 Burgess ..... E04H 4/1654 15/1.7
4,168,557 A * 9/1979 Rasch ..... E04H 4/1654 15/1.7
5,197,158 A * 3/1993 Moini ..... E04H 4/1654 15/1.7
6,379,113 B1 4/2002 Kim
(Continued)

FOREIGN PATENT DOCUMENTS

CN 1538022 A 10/2004
CN 1244747 C 3/2006
(Continued)

OTHER PUBLICATIONS

U.S. Appl. No. 14/284,386, filed May 21, 2014, Wing-Kin Hui, et al.
U.S. Appl. No. 14/331,164, filed Jul. 14, 2014, ALL GOOD INC., LIMITED.
U.S. Appl. No. 14/551,894, filed Nov. 24, 2014, Wing-Tak Hui, et al.
(Continued)

*Primary Examiner* — Randall Chin
(74) *Attorney, Agent, or Firm* — Bowen Liu; Jennifer A. Haynes; David Lewis

(57) ABSTRACT

A pool cleaner having an intake opening at the bottom of the body and two rollers on either side of the intake opening on which the pool cleaner rests and traverse the pool floor. In an embodiment, the rollers define a cleaning path with maximum water flow through the intake opening into the pool cleaner caused by hydraulic forces as a result of at least one pump being turned on. In an embodiment, pool cleaner is unstable when moving on the rollers. In an embodiment, wheels are placed at corners of the pool cleaner and raised above the floor, allowing a rocking motion and easy turns of pool cleaner.

37 Claims, 13 Drawing Sheets

(56) References Cited

U.S. PATENT DOCUMENTS

| | | | | |
|---|---|---|---|---|
| 6,412,133 | B1 | 7/2002 | Erlich et al. | |
| 7,213,287 | B2 | 5/2007 | Hui | |
| 8,273,183 | B2 | 9/2012 | Erlich et al. | |
| 8,627,532 | B2 | 1/2014 | Hui | |
| 8,784,652 | B2 | 7/2014 | Rief et al. | |
| 9,032,575 | B2 * | 5/2015 | Sebor | E04H 4/1654 15/1.7 |
| 9,091,092 | B1 | 7/2015 | Hui et al. | |
| 9,246,290 | B1 | 1/2016 | Hui et al. | |
| 9,366,049 | B1 | 6/2016 | Hui et al. | |
| 2007/0157413 | A1 * | 7/2007 | Roumagnac | E04H 4/1654 15/302 |
| 2007/0251032 | A1 | 11/2007 | Pichon et al. | |
| 2013/0030659 | A1 * | 1/2013 | Porat | E04H 4/1654 701/49 |
| 2013/0146106 | A1 | 6/2013 | Erlich | |
| 2013/0269729 | A1 | 10/2013 | Erlich et al. | |
| 2014/0014140 | A1 * | 1/2014 | Correa | B08B 9/087 134/34 |
| 2014/0076789 | A1 | 3/2014 | Shlomi-Shlomi et al. | |
| 2014/0262997 | A1 | 9/2014 | Renaud et al. | |
| 2015/0233135 | A1 | 8/2015 | Hui et al. | |
| 2015/0337555 | A1 | 11/2015 | Hui et al. | |
| 2016/0013603 | A1 | 1/2016 | Hui et al. | |
| 2016/0145885 | A1 | 5/2016 | Hui et al. | |

FOREIGN PATENT DOCUMENTS

| | | | |
|---|---|---|---|
| CN | 101666168 | B | 1/2011 |
| CN | 105625761 | A | 6/2016 |
| EP | 1022411 | A2 | 7/2000 |
| EP | 2447449 | A2 | 5/2012 |
| EP | 2484847 | A1 | 8/2012 |
| EP | 2554765 | A2 | 2/2013 |
| EP | 3023561 | A1 | 5/2016 |
| FR | 2581689 | A1 | 11/1986 |
| FR | 2925551 | A1 | 6/2009 |
| FR | 2934630 | A1 | 2/2010 |
| WO | WO/2011/100067 | A1 | 8/2011 |
| WO | WO 2014/070301 | A1 | 5/2014 |

OTHER PUBLICATIONS

Aqua Products, Inc. v. Intex Recreation Corp. United States District Court, S.D. New York, No. 06 CV 1746(LAP), Jun. 5, 2007.

Zodiac Pool Systems, Inc. V. Aqua Products, Inc.: Final. Written Decision IPR2013-00159. Paper 71. Aug. 22, 2014. Aprin, © 2014 Drinker Biddle & Reath LLP. Published on the National Law Review (http://www.natlawreview.com).

Search Report issued in European patent application No. EP15195875.8 (publication No. EP3034718A1), (2016).

* cited by examiner

ADVANCED POOL CLEANER CONSTRUCTION

CROSS-REFERENCE TO RELATED APPLICATIONS

This application is a continuation-in-part of U.S. patent application Ser. No. 14/551,894, now U.S. Pat. No. 9,366,049, entitled, "JET PROPELLED POOL CLEANER," filed Nov. 24, 2014, by Wing-Tak Hui et al., which is incorporated herein by reference.

FIELD

This specification generally relates to pool cleaners.

BACKGROUND

The subject matter discussed in the background section should not be assumed to be prior art merely as a result of its mention in the background section. Similarly, a problem and the understanding of the causes of a problem mentioned in the background section or associated with the subject matter of the background section should not be assumed to have been previously recognized in the prior art. The subject matter in the background section may merely represent different approaches, which in-and-of-themselves may also be inventions.

Presently, there are various pool cleaners that can clean swimming pools by filtering the pool water and removing dirt debris and algae. There are various pools with different sizes and/or shapes. To clean various pools, pool cleaners need to move in the water across the entire floor of the pools. This specification recognizes that is a need for increasing suction efficiency of pool cleaners and enhancing the agility of the movement of pool cleaners when traversing the entire floor of the pool.

BRIEF DESCRIPTION OF THE FIGURES

In the following drawings like reference numbers are used to refer to like elements. Although the following figures depict various examples of the invention, the invention is not limited to the examples depicted in the figures.

DETAILED DESCRIPTION

Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

In general, at the beginning of the discussion of each of FIGS. 1A-7 is a brief description of each element, which may have no more than the name of each of the elements in the one of FIGS. 1A-7 that is being discussed. After the brief description of each element, each element is further discussed in numerical order. In general, each of FIGS. 1A-9 is discussed in numerical order and the elements within FIGS. 1A-9 are also usually discussed in numerical order to facilitate easily locating the discussion of a particular element. Nonetheless, there is no one location where all of the information of any element of FIGS. 1A-9 is necessarily located. Unique information about any particular element or any other aspect of any of FIGS. 1A-9 may be found in, or implied by, any part of the specification.

In various places in discussing the drawings a range of letters, such as a-n are used to refer to individual elements of various series of elements that are the same. In each of these series, the ending letters are integer variables that can be any number. Unless indicated otherwise, the number of elements in each of these series is unrelated to the number of elements in others of these series. Specifically, even though one letter (e.g. "c") comes earlier in the alphabet than another letter (e.g., "n"), the order of these letters in the alphabet does not mean that the earlier letter represents a smaller number. The value of the earlier letter is unrelated to the later letter, and may represent a value that is greater the same or less than the later letter.

Figure 1A:
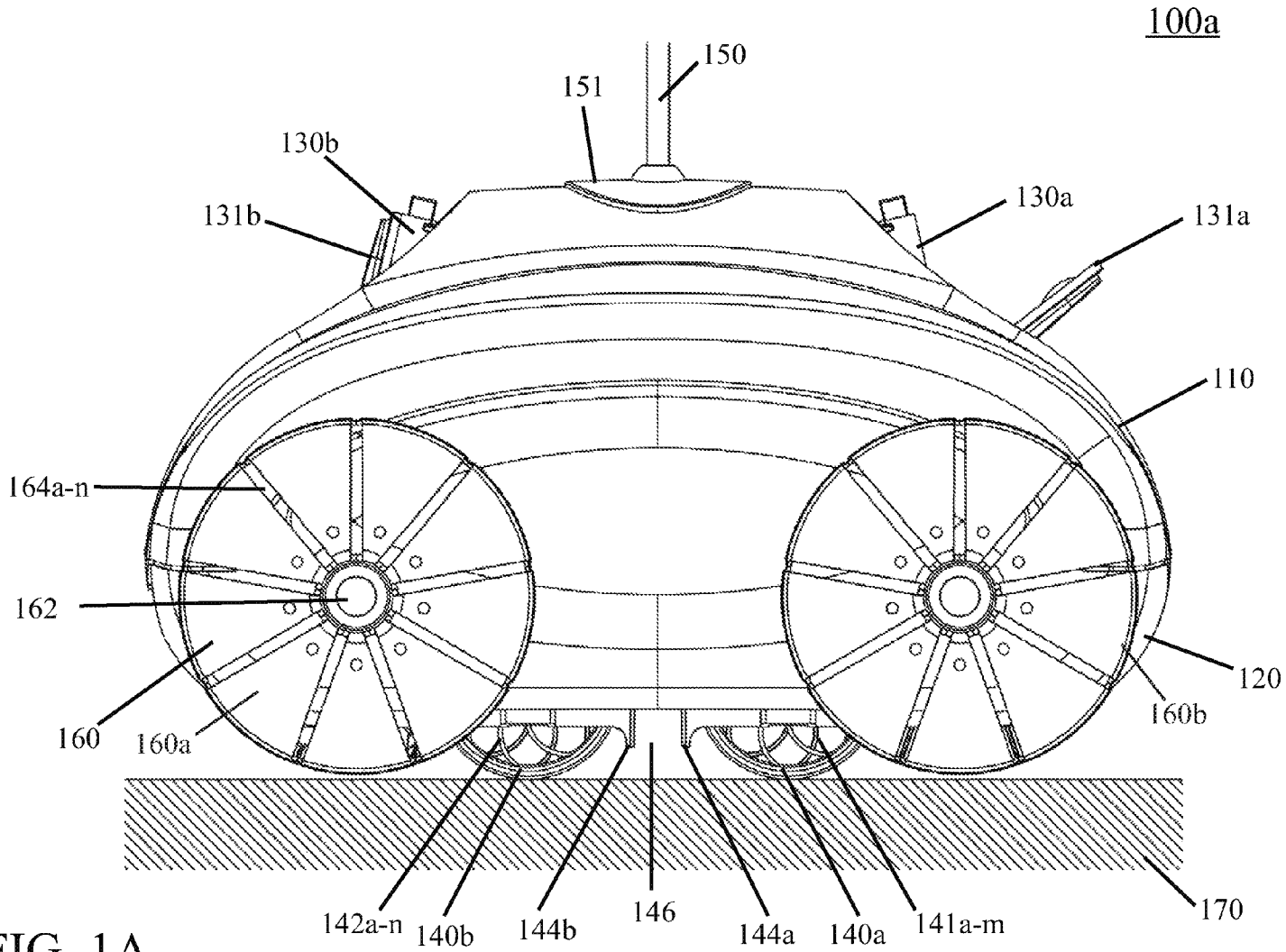
FIG. 1A shows a side view of an embodiment of a pool cleaner.

FIG. 1A shows a side view of an embodiment of a pool cleaner 100*a*. Pool cleaner 100*a* includes at least a head 110, a base 120, two pumps 130*a* and 130*b*, and a pair of flaps 131*a* and 131*b*. Pool cleaner 100*a* also includes a pair of rollers 140*a* and 140*b* having spokes 141*a-m* and 142*a-n*, respectively, two walls 144*a* and 144*b*, an intake opening 146, a power cord 150, a cap 151, a plurality of wheels 160 that includes at least wheels 160*a* and 160*b*, wheel axles 162, and slits 164*a-n*. FIG. 1A also shows floor 170. In other embodiments, pool cleaner 100*a* may not have all of the elements or features listed and/or may have other elements or features instead of or in addition to those listed.

Pool cleaner 100*a* is a cleaning machine that may be used to remove debris and filter pool water. Generally, pool cleaner 100*a* is submerged and operated under water. In at least one embodiment, pool cleaner 100*a* has an intake opening at the bottom of the pool cleaner 100*a*, through which pool water is drawn into the body of the pool cleaner 100*a* caused by hydraulic pressure within the body as a result of a pump(s) being turned on. In at least one embodiment, the intake opening is located between two rollers that are axle-mounted to the bottom of the pool cleaner 100*a*, on which pool cleaner 100*a* traverses the floor of the pool. In at least one embodiment, the rollers are parallel to each other and perpendicular to the directions that the pump(s) faces. In at least one embodiment, the distance between the rollers and chassis at the bottom of the pool cleaner 100*a* is minimized, so as to prevent water from flowing around the rollers. In at least one embodiment, between the rollers is a path with the maximum water flow through the intake opening into the body of pool cleaner 100*a*. In at least one embodiment, suction efficiency of pool cleaner 100*a* is enhanced by limiting the space between the rollers and minimizing the gaps between the rollers and the bottom chassis of pool cleaner 100*a*.

In at least one embodiment, pool cleaner 100*a* traverses the floor of the pool making turns and/or making zigzag routes that eventually covers the entire floor of the pool or a water tank. In at least one embodiment, pool cleaner 100*a* is propelled by pumps pointing in opposite directions, which optionally may be tilted upwards. In an embodiment, the pumps are turned on alternatively in order to propel the pool cleaner 100*a* in alternating directions. In at least one embodiment, the rollers are located close to each other, and both rollers may be adjacent to the middle of the pool cleaner 100*a*, such that pool cleaner 100*a* is unstable because of the short wheelbase (i.e., the short distance between the axles of the rollers). In at least one embodiment, the propulsion caused by exiting water is applied to the body of pool cleaner 100*a* outside the wheelbase, providing a good leverage and making it easier for pool cleaner 100*a* to turn sideways and/or change paths. In at least one embodiment, a plurality of wheels are installed on the corners of pool cleaner 100*a* and raised above the floor of the pool, for facilitating the movement of pool cleaner 100*a* in a rocking motion and/or when making turns. In at least one embodiment, one or more of the wheels come in contact with the floor when pool cleaner 100*a* is rocking, making turns, and/or moving on an uneven floor. As a result of the rocking motion, pool cleaner 100*a* is able to climb over obstacles that pool cleaner 100*a* would not be able to climb over otherwise.

Head 110 is a top portion of the pool cleaner 100*a* that connects to a base to form the body of pool cleaner 100*a*. In at least one embodiment, head 110 includes a part of an approximately oval shaped top cover with two oval shaped openings in either end along longitudinal axis of the head 110, which in an embodiment, face upwards at an angle in approximately opposite directions (in other embodiments, the top cover may have other shapes and the openings do not face upwards). In at least one embodiment, head 110 includes at least two tilted pumps facing the oval shaped openings for pumping water out of the body of pool cleaner 100*a*. In at least one embodiment, each of the two pumps has an adjustable flap that controls the direction of flow of water exiting the pool cleaner 100*a*. In at least one embodiment, a power cord is connected to the pool cleaner 100*a* through the top of the head 110, while at the other end connects to a power outlet such as an AC outlet for powering pool cleaner 100*a*. In at least one embodiment, head 110 is pivotally connected (e.g., hinged) to the base of pool cleaner 100*a*, so as to swing open, and may be locked via a fastener such as a latch. In at least one embodiment, the pool cleaner 100*a* may be opened in another manner, head 110 may be attached to pool cleaner 100*a* in another manner (e.g., without being hinged), and/or may include other structures and/or shapes.

Base 120 is the bottom portion of pool cleaner 100*a* that is connected to the head 110 to form the body of pool cleaner 100*a*. In at least one embodiment, base 120 includes a receiving portion that engages with the fastener on the head 110 for locking the head 110 to the base 120 when the pool cleaner 100*a* is in use. In at least one embodiment, a filter may be connected to the base 120 for removing debris and filtering pool water when pool cleaner 100*a* is on (alternatively the filter may be connected to head 110). In at least one embodiment, an intake opening is located at the bottom of base 120, which serves as an inlet for the pool water to enter the body, so that the water is filtered by the filter within the body of pool cleaner 100*a*. In at least one embodiment, base 120 moves on two rollers that are axle-mounted to the bottom of base 120, one on either side of the intake opening, with the axels perpendicular to the directions that the pumps faces. In at least one embodiment, base 120 includes four wheels installed on the corners of the base 120, which are lifted off the ground for supporting pool cleaner 100*a* in a rocking motion or when making turns, preventing pool cleaner 100*a* from tipping over. In at least one embodiment, base 120 may include other structures and/or shapes.

In at least one embodiment, the body of pool cleaner 100*a*, which is formed by the head 110 and the base 120, is 15.75 inches long and 10.25 inches wide, and has a height of 9 inches. It should be understood that modifications may be made without departing from the essential teachings of the invention. In this specification, the dimensions of the elements of pool cleaner 100*a* may have a tolerance of 10%, 20%, 30%, 50%, 60%, 70%, 80%, or 90%. In other embodiments other dimensions may be used that are outside of the tolerances of the dimensions mentioned above. In another embodiment, the dimensions of the elements of pool cleaner 100*a* may be twice, three times, or four times larger. In yet another embodiment, the dimensions of the elements of pool cleaner 100*a* may be one half, one third of, one fourth of, or one fifth of the dimensions described above. In other embodiments, the body of pool cleaner 100*a* may have other dimensions and/or other shapes. Of course, components that are intended to fit snugly within one another need to vary together so that those components still fit within one another, snugly.

Pumps 130*a* and 130*b* are water pumps that are capable of moving water surrounding the pumps 130*a* and 130*b*. More specifically, pumps 130*a* and 130*b* draw water through the intake opening into the body of pool cleaner 100*a* and push water out of the body through discharge openings of the pool cleaner 100*a*. In an embodiment, each of pumps 130*a* and 130*b* may include a propeller to move the water through the pool cleaner 100*a*. In an embodiment having a propeller, the end of each of pumps 130*a* and 130*b* that has the propeller is a discharge end of pumps 130*a* and 130*b*. Pumps 130*a* and 130*b* may be electromechanical pumps that are powered by electric motors. Embodiments of pumps 130*a* and 130*b* were discussed in details in conjunction with U.S. patent application Ser. No. 14/551,894.

Flaps 131*a* and 131*b* are circular plates that are pivotally connected to and cover discharge ends of the pumps 130*a* and 130*b*, respectively. In at least one embodiment, flaps 131*a* and 131*b* are mechanically biased to stay closed to cover the discharge ends of pumps 130*a* and 130*b* until being pushed open by water exiting the discharge openings. In at least one embodiment, flaps 131*a* and 131*b* may be opened facing upwards at a predetermined angle. In at least one embodiment, flaps 131*a* and 131*b* may be connected to rotatable portions of the pumps 130*a* and 130*b* such that flaps 131*a* and 131*b* may face sideways. In other embodiments, flaps 131*a* and 131*b* may include other structures. Embodiments of flaps 131*a* and 131*b* and the rotatable portions were discussed in details in conjunction with U.S. application Ser. No. 14/551,894.

Rollers 140*a* and 140*b* are two tubular structures that are axle-mounted to the bottom of the base 120, on which the pool cleaner 100*a* traverses the floor of the pool. In at least one embodiment, rollers 140*a* and 140*b* are parallel to each other, perpendicular to the directions that the pumps 130*a* and 130*b* faces. In an alternative embodiment, rollers 140*a* and 140*b* may not be perfectly parallel to each other. In at least one embodiment, the ends of rollers 140*a* and 140*b* extend to the sides of the body of pool cleaner 100*a*, with the intake opening located between the roller 140*a* and 140*b*. In at least one embodiment, the rollers 140*a* and 140*b*, together with the bottom of the pool cleaner 100*a* and the floor between the rollers, define a space with maximum water flow (e.g., a cleaning path in which water is drawn into the body of pool cleaner 100*a* through the intake opening). In at least one embodiment, each of rollers 140*a* and 140*b* is located in and mounted to a chassis at the bottom of base 120, which is a portion of a tubular shaped groove facing the floor. In at least one embodiment, the space between the perimeters of the rollers 140*a* and 140*b* and the chassis is minimized so as to minimize the flow of water around the rollers into the cleaning path. In at least one embodiment, water from sideways of the pool cleaner 100*a* flows to the cleaning path and then into the body of pool cleaner 100*a*.

In at least one embodiment, rollers 140*a* and 140*b*, which are close to each other, are adjacent to the middle of pool cleaner 100*a* for creating a short wheelbase. In this specification, "wheelbase" is defined as "the distance in inches between the front and rear axles" (cf. the Merriam-Webster Dictionary). Specifically, the wheelbase of pool cleaner 100*a* is defined as the distance between the axles of rollers 140*a* and 140*b*. In at least one embodiment, propulsion force caused by the pump(s) is applied to the body of pool cleaner 100*a* that falls outside the wheelbase, and provides a good leverage when pushing the pool cleaner 100*a* sideways. In at least one embodiment, pool cleaner 100*a* has high center of gravity, because the majority of the mass of pool cleaner 100*a* is close to the top of head 110. In at least one embodiment, the pumps 130*a* and 130*b* are relatively heavy compared to the rest of the pool cleaner 100*a* and are affixed in the head 110 while the materials for making base 120 are mostly light-weight. In at least one embodiment, pool cleaner 100*a* is unstable as a result of the short wheelbase and/or high center of gravity, which tends to cause pool cleaner 100*a* to rotate about the axle of either of the rollers 140*a* and 140*b*. In at least one embodiment, the ratio of distance from the center of gravity to the floor and the distance between the rollers 140*a* and 140*b* affects the stability of the pool cleaner 100*a*. In an embodiment, the torque about the axle of the lagging roller due to the weight of pool cleaner 100*a* should be only slightly more than or less than the torque about the lagging roller caused by the water pushing on the forward portion of pool cleaner 100*a*, as the pool cleaner 100*a* travels, so that an additional torque caused by a small current on the forward portion of the pool cleaner 100*a* is enough to cause pool cleaner 100*a* to rock backwards pivoting on the lagging roller. The forward portion of the pool cleaner 100*a* is the portion that points in the direction of travel of the pool cleaner 100*a*, and the lagging roller is the roller furthest from the forward portion of the pool cleaner 100*a*. In at least one embodiment, the higher the center of gravity and/or the shorter the wheelbase, the more unstable the pool cleaner 100*a*. As a result of being unstable it requires less force sideways for pool cleaner 100*a* to make turns and/or change paths easily, so as to travel in a random path, which over time is likely to cover the surface of the pool.

In at least one embodiment, the rollers 140*a* and 140*b* have a radius of 1.3 inches and a length of 8.6 inches. In at least one embodiment, the axles of rollers 140*a* and 140*b* are 4.2 inches apart. In at least one embodiment, the center of gravity of the pool cleaner 100*a* is 3.9 inches above the floor and 2.6 inches from the plane of the axles of the rollers 140*a* and 140*b*. In another embodiment, the center of gravity may be in other locations and/or have other distance from the axles of the rollers 140*a* and 140*b* or the floor. In other embodiments, the rollers 140*a* and 140*b* may have other dimensions and/or sizes, and the distance between the rollers 140*a* and 140*b* may have a different value.

In at least one embodiment, rollers 140*a* and 140*b* are not actively powered. In another embodiment, rollers 140*a* and 140*b* may be powered (e.g., may be driven by motors). In at least one embodiment, rollers 140*a* and 140*b* may be solid. In at least one embodiment, pool cleaner 100*a* may include other numbers of rollers. In at least one embodiment, pool cleaner 100*a* may include other numbers of intake openings, each located between two adjacent rollers. In at least one embodiment, rollers 140*a* and 140*b* may include other shapes and/or structures. In at least one embodiment, other traversing means may be substituted for, or added in addition to, rollers 140*a* and 140*b* to obtain different embodiments.

Spokes 141*a-m* and 142*a-n* are a number of spiral rods or slats positioned radially from hubs to the perimeters of the ends of rollers 140*a* and 140*b*, respectively, forming openings between the spokes 141*a-m* and 142*a-n*. In at least one embodiment, spokes 141*a-m* and 142*a-n* serve to connect the tubular walls of rollers 140*a* and 140*b* to ring shaped hubs on each end. In at least one embodiment, each of the ring shaped hubs includes a hole for the axles to go through to connect the roller to the chassis at the bottom of base 120. In at least one embodiment, spokes 141*a-m* and 142*a-n* include other numbers and/or structures. In at least one embodiment, other structures may be substituted for spokes 141*a-m* and 142*a-n* for connecting rollers 140*a* and 140*b* to the axles.

Walls 144*a* and 144*b* are at the bottom of the base 120, each including a part of a tubular shaped groove facing the floor. In at least one embodiment, rollers 140*a* and 140*b* are located and rotate within walls 144*a* and 144*b*, respectively. In at least one embodiment, the space between the tubular walls of the rollers 140*a* and 140*b* and the walls 144*a* and 144*b*, respectively, is minimized (e.g., less than 0.2" (5 mm)) so as to minimize the flow of water around the rollers 140*a* and 140*b* into the cleaning path that is between rollers 140*a* and 140*b*. In at least one embodiment, the sides of walls 144*a* and 144*b* that are close to each other define the sides of the intake opening. In at least one embodiment, the sides of walls 144*a* and 144*b* defining the intake opening protrude from the bottom of base 120 toward the floor of the pool. In another embodiment, the sides of walls 144*a* and 144*b*, which define the intake opening, is on the same plane of the bottom of base 120, or above the plane of the bottom of base 120 when pool cleaner 100*a* is placed on the rollers 140*a* and 140*b* on pool floor. In at least one embodiment, the walls of a filter housing protrude from the top of the walls 144*a* and 144*b* towards the head 110, forming a housing for attaching a filter. In at least one embodiment, the sides of walls 144*a* and 144*b* adjacent to the intake opening are 0.94 inch apart, and 0.3 inch lower than the bottom of the base 120. In at least one embodiment, the sides of walls 144*a* and 144*b* adjacent to the intake opening are 1 inch below the intake opening. In other embodiments, the walls 144*a* and 144*b* may have other dimensions and/or shapes.

Intake opening 146 is an opening at the bottom of the base 120, through which water is drawn into the body of pool cleaner 100*a*. In at least one embodiment, intake opening 146 is located between rollers 140*a* and 140*b*. In at least one embodiment, intake opening 146 is defined by the sides of walls 144*a* and 144*b* that are adjacent to each other. In at least one embodiment, the length of intake opening 146 is equal to or shorter than the length of the walls 144*a* and 144*b*. In at least one embodiment, the intake opening 146 is 0.94 inch wide, and 6 inches long, parallel to the width of the base 120. In other embodiments, the intake opening 146 may have other dimensions and/or shapes. In at least one embodiment, the filter housing is located above the intake opening 146, to which the filter is attached and filters water that flows from the cleaning path through the intake opening 146 into the body of pool cleaner 100*a*.

Power cord 150 is an insulated electrical cord that connects pool cleaner 100*a* to a power outlet such as an AC outlet. Power cord 150 transmits the electricity from the power outlet to pool cleaner 100*a* to power the two pumps 130*a* and 130*b* as needed. Power cord 150 may run through a cover on the top of head 110 to further connect to a pump assembly inside the body of pool cleaner 100*a*. In at least one embodiment, the electrical connections between power cord 150 and the pump assembly are hermetically sealed.

Cap 151 is a cap that is attached to the top of the head 110, through which the power cord 150 passes and/or connects to the pump assembly that includes pumps 130*a* and 130*b* inside pool cleaner 100*a*. In at least one embodiment, cap 151 may include other structures and/or shapes.

Wheels 160 are pivotally attached to axles that are connected to the base 120 to facilitate the movement of pool cleaner 100*a* across the floor of the pool. In at least one embodiment, four wheels 160 are connected to the corners of the base 120, and are raised above the floor when pool cleaner 100*a* is on a flat surface of the floor. In at least one embodiment, the perimeters of wheels 160 are at a preset distance (e.g., 5 mm, 10 mm, 20 mm) off the ground. In at least one embodiment, the wheels 160 have a radius of 2.75 inches. In at least one embodiment, the axles of two wheels 160*a* and 160*b* are 9.63 inches apart. In other embodiments, the wheels 160 of pool cleaner 100*a* may have other dimensions, and/or may be installed in other locations on the pool cleaner 100*a*.

In at least one embodiment, when pool cleaner 100*a* traverses the floor on rollers 140*a* and 140*b*, one or more of the wheels 160 may come in contact with the floor from time to time, causing a rocking motion as a result of pool cleaner 100*a* being unstable and/or moving on an uneven floor. In at least one embodiment, the rocking motion of pool cleaner 100*a* facilitates the movement on a floor that is not flat or has obstacles (e.g., drain cover of the pool). In at least one embodiment, the amount that wheels 160 are raised above the floor determines the degree to which the pool cleaning 100*a* may rock (e.g., how far pool cleaner tilts while rocking), while combination of the height of the center of gravity, the speed of travel, and the distance between the rollers determines the frequency of rocking. In a pool having calm waters, the most significant currents (if there are any currents) are the current created by an ordinary pool filter and the motion of the pool cleaner 100*a*. In at least one embodiment, pool cleaner 100*a* rocks every few seconds while traveling on the floor of the pool, while in calm water. In other embodiment, pool cleaner 100*a* rocks at least once every minute while traveling, while in calm water. In other embodiment, pool cleaner 100*a* rocks at least once every ten minutes while traveling. In another embodiment, pool cleaner 100*a* rocks at least once every foot of travel, while in calm water. In another embodiment, pool cleaner 100*a* rocks at least once every ten feet, while in calm water. In yet another embodiment, pool cleaner 100*a* rocks twice every ten feet, while in calm water. In yet another embodiment, pool cleaner 100*a* rocks three times every ten feet. In another embodiment, pool cleaner 100*a* rocks at least once every twenty five feet. In another embodiment, pool cleaner 100*a* rocks at least once every one hundred feet. In yet another embodiment, pool cleaner 100*a* rocks several times every ten feet. In other embodiments, pool cleaner 100*a* may rock less frequently or more frequently than discussed above in this paragraph.

In at least one embodiment, when pool cleaner 100*a* is propelled sideways or moves on an uneven floor, pool cleaner 100*a* may turn about one of the wheels 160 that is temporarily in contact with the floor. In at least one embodiment, the wheel that is in contact with the floor may rotate when pool cleaner 100*a* turns, until the wheel is off the ground again. In at least one embodiment, the wheel that rotates on the floor facilitates the pool cleaner 100*a* to randomly make a sharp turn. In at least one embodiment, the rotation of the wheel on the floor, about which pool cleaner 100*a* turns, may prevent scraping of the floor. In various embodiments, there may be various numbers of wheels (e.g., 3, 4, 5, 6, or 8, for example) attached to the base 120. In other embodiments, wheels or other traversing means may be attached in other places of pool cleaner 100*a*.

Wheel axles 162 are the axles on which wheels 160 are mounted. Wheel axles 162 may be mounted in holes or wells on the sides of base 120. In at least one embodiment, wheels 160 rotate about the wheel axles 162. In at least one embodiment, each of the wheels 160 may be connected to the base 120, via an axle, which is separate from the other axles of the other wheels (each wheel having its own axle).

Slits 164*a-n* are a plurality of slits or slots extending radially from the middle portion of wheels 160 to the perimeters. Slits 164*a-n* are optional.

Floor 170 is the floor of the pool or water tank. In at least one embodiment, floor 170 is submerged under water. In at least one embodiment, floor 170 may be flat as shown in FIG. 1A. In another embodiment, floor 170 may be uneven, and/or may have obstacles. In at least one embodiment, pool cleaner 100*a* traverses the floor 170 on rollers 140*a* and 140*b* in a rocking motion, when one or more of the wheels 160 come in contact with floor 170 from time to time. In another embodiment, pool cleaner 100*a* rides on rollers 140*a* and 140*b*, which are in contact with the floor 170, while the wheels 160 are raised above floor 170.

Figure 1B:
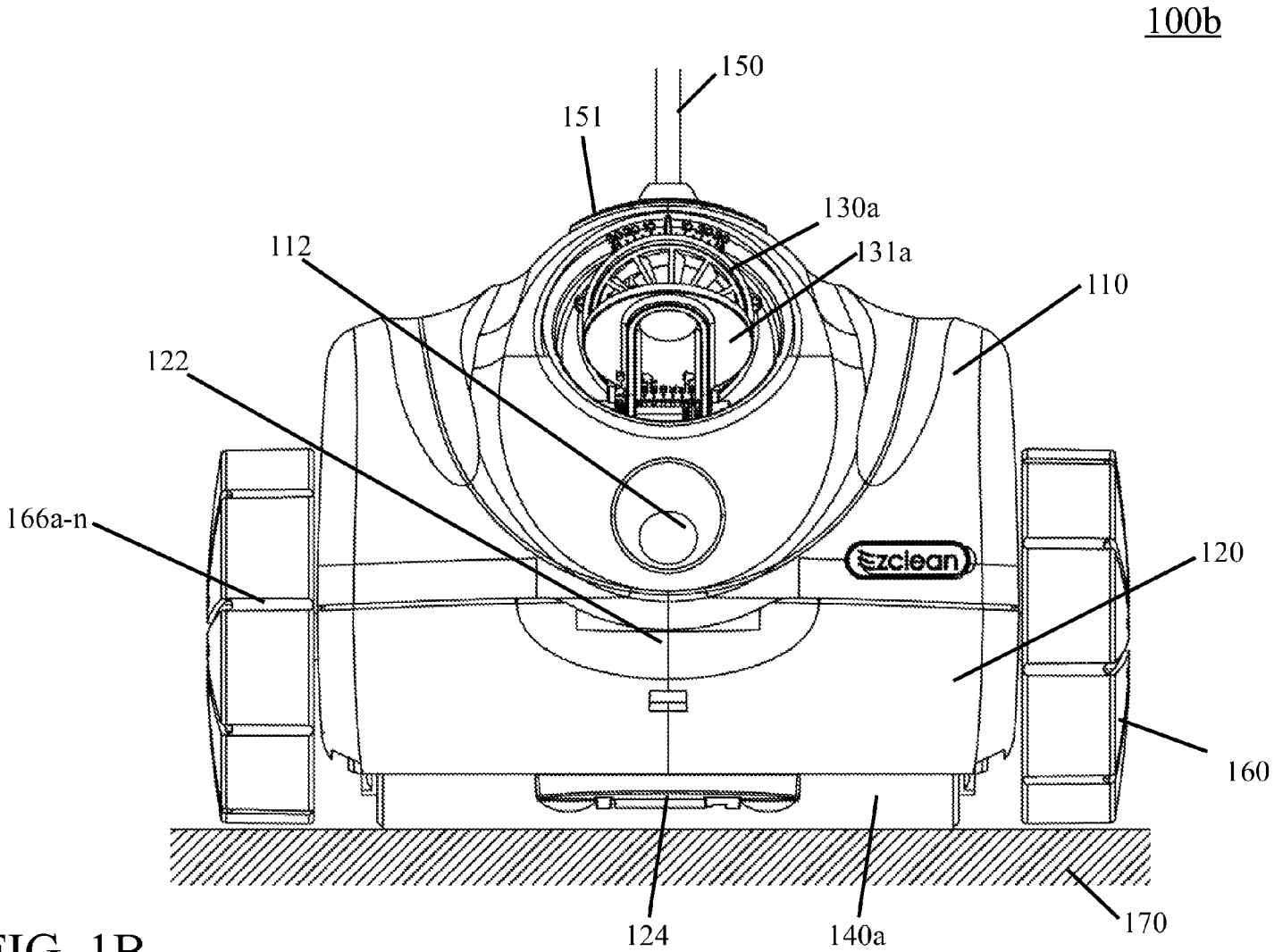
FIG. 1B shows a front view of an embodiment of the pool cleaner of FIG. 1A.

FIG. 1B shows a front view 100*b* of an embodiment of the pool cleaner 100*a* of FIG. 1A. FIG. 1B may include head 110, base 120, pumps 130*a*, flap 131*a*, roller 140*a*, power cord 150, cap 151, wheels 160, and floor 170, which were discussed in conjunction with FIG. 1A. FIG. 1B may further include a fastener 112, a receiving portion 122, a quick drain door 124, and a plurality of grooves 166*a-n*. In other embodiments, the assembly of FIG. 1B may not have all of the elements or features listed and/or may have other elements or features instead of or in addition to those listed.

FIG. 1B shows a front view of the pool cleaner 100*a*. In FIG. 1B, pool cleaner 100*a* moves or stays on rollers 140*a* (and 140*b* that is not shown in FIG. 1B). In at least one embodiment, roller 140*a* (and/or 140*b*) extends across the width of the base 120. FIG. 1B also shows that wheels 160 are raised off the ground on a flat surface of floor 170 when not rocking Fastener 112 is a mechanical fastener, such as a latch, that holds the head 110 and the base 120 to one another, closing and locking the two components together. Fastener 112 may have a clasp or hook portion that is located on the side of the head 110 that engages a receiving portion located on the base 120. The clasp or hook portion may have a spring mechanism, and may be pressed to release the fastener 112 for opening the body of the pool cleaner 100*a*. In at least one embodiment, the body of pool cleaner 100*a* may be opened by releasing fastener 112 to remove debris and/or clean the filter. In this specification, whenever one type of fastener is used another type of fastener may be substituted to obtain a different embodiment. For example, latches, screws, snaps, rivets, glue, adhesives, straps and/or tabs (that is, tabs that engage in slots), may be used for any of the fasteners in this specification. Latches, screws, snaps, rivets, tabs (tabs that engage in slots), glue, adhesives, and/or straps may be substituted one for another to obtain different embodiments. Also, many fasteners have two parts that interlock with one another to hold two pieces together, where one of the two parts of the fastener is attached to one piece and another of the two parts is attached to another piece. In this specification, which piece of the fastener is attached to which part may be reversed to obtain different embodiments. For example, if a top piece has a slot and a bottom piece has a latch that interlock with the slot, whether the top piece has the slot and the bottom piece has the latch may be reversed from that which is shown in the drawings to obtain another embodiment.

Receiving portion 122 is a panel on the base 120 for interlocking with the fastener 112. In at least one embodiment, a hook of the fastener 112 fits over the receiving portion 122, so as to hold and lock the head 110 and base 120 of pool cleaner 100*a* together.

Quick drain door 124 is a spring loaded flap that closes an opening at the bottom of the base 120 when pool cleaner 100*a* is in use. The hydraulic pressure within the body of pool cleaner 100*a* keeps quick drain door 124 closed. When the pool cleaner 100*a* is turned off and lifted out of the pool, the lack of hydraulic pressure within the body causes the water push open quick drain door 124 and flow out of the body of pool cleaner 100*a*.

Grooves 166*a-n* are grooves on the rim of the wheels 160 facing outwards. In at least one embodiment, grooves 166*a-n* align with slits 164*a-n*, respectively. In at least one embodiment, there are different numbers of grooves 166*a-n* and slits 164*a-n*, and/or grooves 166*a-n* and slits 164*a-n* do not align with one another. Grooves 166*a-n* are optional.

Figure 2:
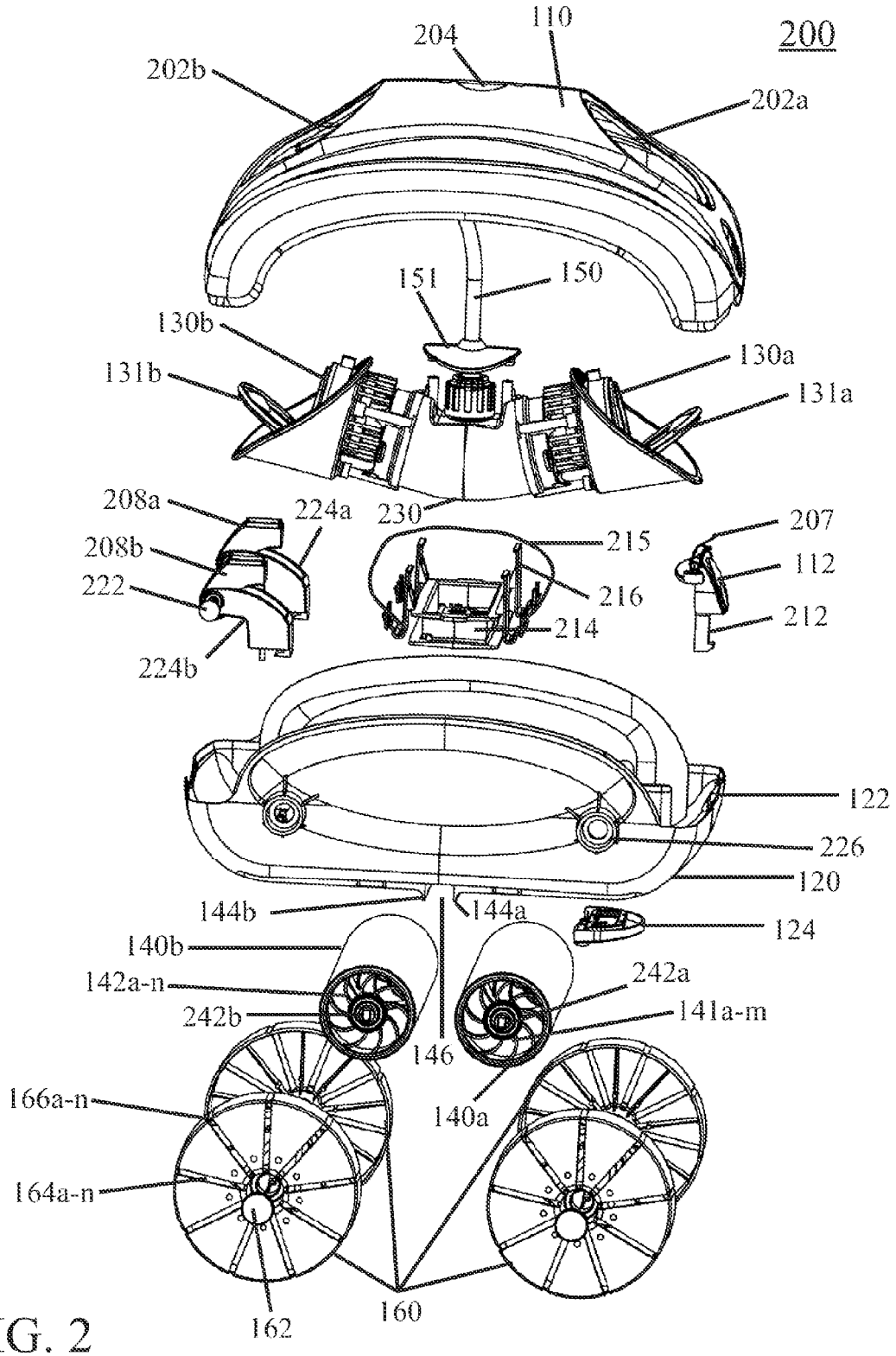
FIG. 2 shows an exploded view of an embodiment of the pool cleaner of FIG. 1A.

FIG. 2 shows an exploded view 200 of an embodiment of the pool cleaner 100*a* of FIG. 1A. FIG. 2 includes head 110, base 120, pumps 130*a* and 130*b*, flaps 131*a* and 131*b*, rollers 140*a* and 140*b*, spokes 141*a-m* and 142*a-n*, walls 144*a* and 144*b*, intake opening 146, power cord 150, cap 151, wheels 160, wheel axles 162, slits 164*a-n*, fastener 112, receiving portion 122, quick drain door 124, and grooves 166*a-n*, which were discussed in conjunction with FIGS. 1A and 1B. FIG. 2 further includes discharge openings 202*a* and 202*b*, a hole 204, a spring 207, supporting members 208*a* and 208*b*, a hook 212, a door frame 214, a filter 215, tabs 216, a pivots 222, pivot mounts 224*a* and 224*b*, axle boss 226, a pump assembly 230, and roller axles 242*a* and 242*b*. In other embodiments, the assembly of FIG. 2 may not have all of the elements or features listed and/or may have other elements or features instead of or in addition to those listed.

Discharge openings 202*a* and 202*b* are two oval shaped openings in either end along longitudinal axis of the head 110, facing upward at an angle in approximately opposite directions (in other embodiments, the discharge openings 202*a* and 202*b* may have other shapes). In at least one embodiment, the two pumps 130*a* and 130*b* installed in the head 110 face the discharge openings 202*a* and 202*b*, respectively, for pumping water out of the body of pool cleaner 100*a*.

Hole 204 is a hole on top of the head 110 for the power cord 150 to go into the head 110 and further connect to the pump assembly. In at least one embodiment, the cap 151 is attached to the top of head 110 and seals the hole 204.

Spring 207 is attached to fastener 112, mechanically biasing the clasp or hook portion of fastener 112 to stay closed after the clasp or hook portion engages the receiving portion on the base 120.

Supporting members 208*a* and 208*b* are structures on which the head 110 is mounted or attached on one end of supporting members 208*a* and 208*b*. In at least one embodiment, each of supporting members 208*a* and 208*b* includes two side panels, which include, near the other end of supporting members 208*a* and 208*b*, holes for inserting pivots. The supporting members 208*a* and 208*b* are connected to the pivots, which are affixed to the base 120. Placing the pivots in the pivot holes forms a hinge that allows the head 110 to rotate about the pivots. In at least one embodiment, the one of the ends of supporting members 208*a* and 208*b* are attached to the head 110, via screws and/or other fasteners. In another embodiment, other numbers of supporting members and/or other structures may be used to pivotally connect the head 110 and base 120.

Hook 212 is a portion of a mechanical fastener that could lock the head 110 and base 120 of pool cleaner 100*a* together when the two components are closed during use or storage. Hook 212 could be unlocked from the receiving portion 122 of base 120 allowing the body of pool cleaner 100*a* to open for cleaning purposes. In one embodiment, hook 212 protrudes from the fastener 112 toward the base 120, opposite to the pivots that connect the head 110 and base 120. Hook 212 fits over the receiving portion 122 located on the base 120, so as to hold and lock the head 110 and base 120 together. Alternatively, a clasp or a latch may be substituted for hook 212 to obtain different embodiments. In other embodiments, other types or numbers of fasteners may be used to hold the head 110 and 120 together.

Door frame 214 is a frame structure that is inserted in the filter housing inside the base 120 for locating an intake door in the intake opening 146. In at least one embodiment, the intake door is pivotally connected to one side of the door frame 214 and is mechanically biased to stay closed to cover the intake opening 146 until pushed open by the water that flows into the body through the intake opening 146 when at least one pump is on. In at least one embodiment, the height of the door frame 214 is equal to or slightly smaller than the height of the filter housing.

Filter 215 is a filter that is installed within the body of pool cleaner 100*a* and blocks any debris in the water from passing through as the water flows out of the body, thereby filtering the water. Filter 215 may include materials such as a fabric that allows water to pass and blocks large particles. In at least one embodiment, filter 215 includes a filter bag that wraps around the filter housing and is held in place by tabs that interlock with receiving portions inside the base 120 of pool cleaner 100*a*. In another embodiment, filter 215 may be attached to the head 110 of the pool cleaner 100*a*. In at least one embodiment, filter 215 may also include brackets or other structures for supporting the fabric or other materials through which the water passes when under hydraulic pressure (e.g., as a result of pumps 130*a* and/or 130*b* being turned on). In at least one embodiment, when at least one of pumps 130*a* and 130*b* is turned on and pushes water out of the pool cleaner 100*a*, lowering the pressure inside the body, which draws water into the body draws open the intake door, through the filter, and then water exits the pool cleaner 100*a* (in this specification the region with the lowered pressure may be referred to as having a "negative" pressure).

Tabs 216 are four tabs that are made of resilient materials such as resilient plastic that act like a spring and after being deformed, tabs 216 tend to return to the original shape of tabs 216. In at least one embodiment, each of tabs 216 on one end includes a wedge shaped head, and on the other end includes a "U" shaped tail that is inserted into and interlocks with one of receiving portions located adjacent to the filter housing. In at least one embodiment, tabs 216 hold and support the filter 215 that that is installed to the filter housing, preventing the filter 215 from touching pumps 130*a* and 130*b* when the filter 215 is under hydraulic pressure. In at least one embodiment, when tabs 216 engage the receiving portions, the wedge shaped head of each tab protrudes toward the filter housing and holds the door frame 214 inside the filter housing.

Pivots 222 are pivot structures that run through holes in pivot mounts that are connected to the base 120, and also through holes in supporting members 208*a* and 208*b* that are connected to the head 110, for holding the head 110 and base 120 together. In at least one embodiment, pivots 222 allow head 110 to swing open while one end is connected to the base 120. In an embodiment, pivots 222 may be replaced with rods. Together with the pivot mounts and supporting members 208*a* and 208*b* form a hinge.

Pivot mounts 224*a* and 224*b* are structures that are connected to the base 120 for holding the pivots 222. In at least one embodiment, one ends of pivot mounts 224*a* and 224*b* are attached to the base 120. In at least one embodiment, each of pivot mounts 224*a* and 224*b* includes a pair of side panels having holes on the other ends away from the base 120, through which the pivots 222 are inserted for connecting pivot mounts 224*a* and 224*b* to supporting members 208*a* and 208*b*. Pivots 222 are placed in pivot mounts 224*a* and 224*b*.

Axle boss 226 is a structure on the side of base 120, which includes a hole for one of the wheel axles 162 to go through to connect the wheel to the base 120.

Pump assembly 230 includes a pump housing and two pumps facing approximately opposite directions, which may be tilted upwards at an angle for positioning two propellers in discharge openings 202*a* and 202*b*, thereby causing water to be pushed directly out of the pool cleaner 100*a* without traveling through a conduit(s). In at least one embodiment, either of flaps 131*a* and 131*b* may be pushed open by the water exiting the discharge openings 202*a* and 202*b*, thus providing a driving force in either direction (e.g., as chosen by a controller) for propelling the pool cleaner 100*a* across the floor of the pool. In at least one embodiment, water that bounces off the flaps 131*a* and/or 131*b* also creates a downward force for keeping the pool cleaner 100*a* staying on the floor of the pool while moving. In at least one embodiment, the speed of the pool cleaner 100*a* may be adjusted by adjusting the angle of opening of the flaps 131*a* and 131*b*, and the direction of the movement of the pool cleaner 100*a* may be adjusted by rotating portions that the flaps 131*a* and 131*b* are connected to, which in turn changes the direction in which the flaps 131*a* and 131*b* may open. In at least one embodiment, the pump assembly was discussed in details in U.S. application Ser. No. 14/551,894.

Roller axles 242*a* and 242*b* are axles on which the rollers 140*a* and 140*b* are mounted, respectively. Roller axles 242*a* and 242*b* may be mounted in holes or wells on the ends of walls 144*a* and 144*b*, respectively. In at least one embodiment, either ends of the rollers 140*a* and 140*b* may be connected to the walls 144*a* and 144*b*, via an axial bolt.

Figure 3A:
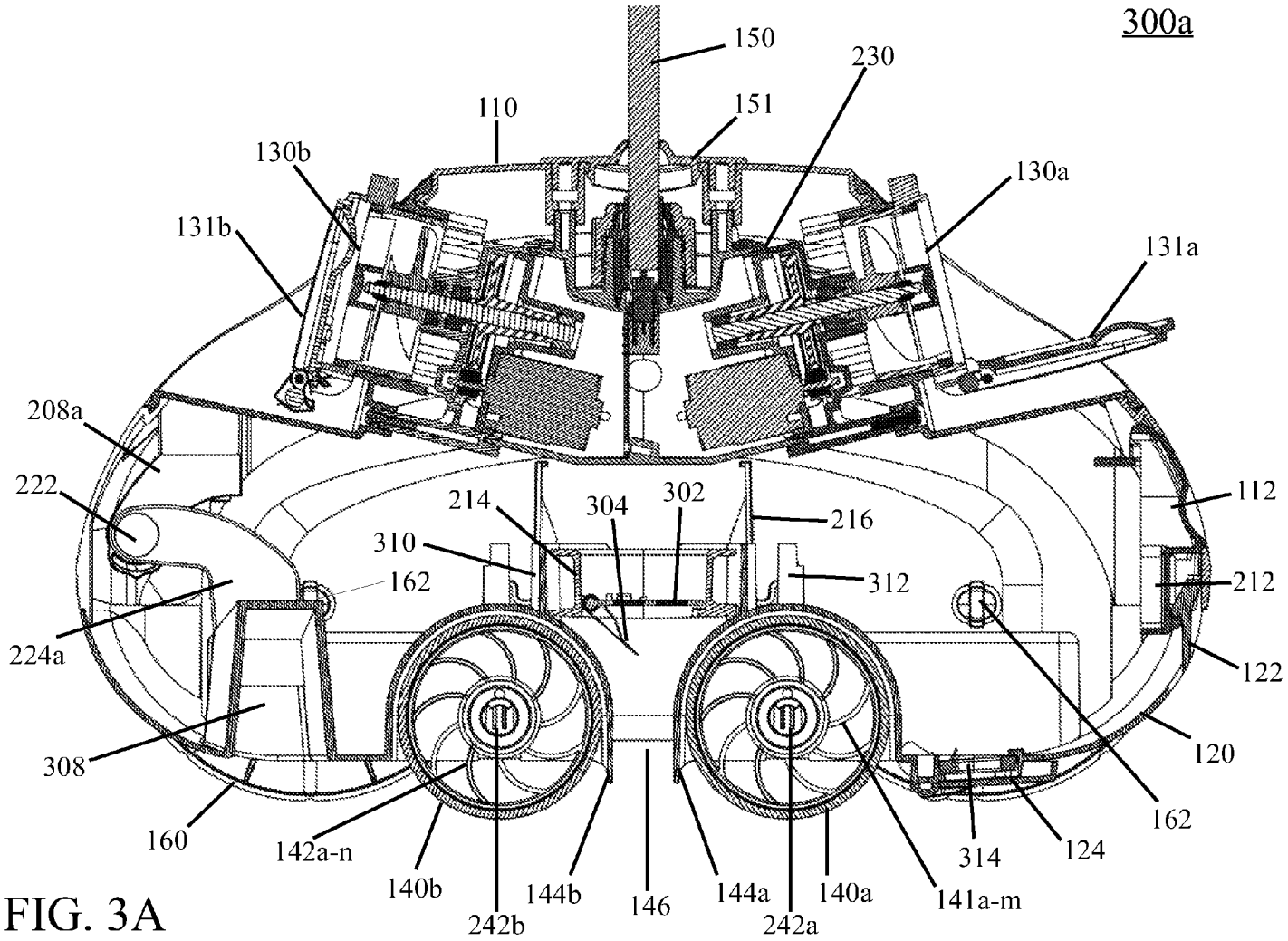
FIG. 3A shows a cross-sectional side view of an embodiment of the pool cleaner of FIG. 1A.

FIG. 3A shows a cross-sectional side view 300*a* of an embodiment of the pool cleaner 100*a* of FIG. 1A. FIG. 3A includes head 110, base 120, pumps 130*a* and 130*b*, flaps 131*a* and 131*b*, rollers 140*a* and 140*b*, spokes 141*a-m* and 142*a-n*, walls 144*a* and 144*b*, intake opening 146, power cord 150, cap 151, wheels 160, wheel axles 162, fastener 112, receiving portion 122, and quick drain door 124, which were discussed in conjunction with FIGS. 1A and 1B. FIG. 3A also includes supporting members 208*a*, hook 212, door frame 214, tabs 216, pivots 222, pivot mount 224*a*, pump assembly 230, and roller axles 242*a* and 242*b*, which were discussed in conjunction with FIG. 2. FIG. 3A may further include a door 302, a spring 304, a grip opening 308, a filter housing 310, receiving portions 312, and a screen 314. In other embodiments, the assembly of FIG. 3A may not have all of the elements or features listed and/or may have other elements or features instead of or in addition to those listed.

FIG. 3A shows the cross sectional view of pool cleaner 100*a*. In FIG. 3A, the head 110 and base 120 are pivotally connected and locked, via fastener 112. The rollers 140*a* and 140*b* are located at the bottom of the base 120, on either side of the intake opening 146. FIG. 3A also shows that the space between roller 140*a* and walls 144*a* (and the space between roller 140*b* and walls 144*b*) is minimized to prevent water from coming through the spaces between rollers and walls into the cleaning path between the rollers 140*a* and 140*b*. The details of the pump assembly 230 with two tilted pumps 130*a* and 130*b* were discussed in conjunction with U.S. patent application Ser. No. 14/551,894.

Intake door 302 is a door that is pivotally attached to the door frame 214 and is biased to stay closed to cover the entrance of the intake opening 146. In at least one embodiment, intake door 302 is mechanically biased, via a spring, to stay closed. In at least one embodiment, intake door 302 may be pushed open by water that flows into the body when the pressure is lowered as a result of at least one of pumps 130*a* and 130*b* being turned on. In at least one embodiment, intake door 302 may include other structures and/or shapes.

Spring 304 is attached to the intake door 302, mechanically biasing the intake door 302 to stay closed and cover the entrance of the intake opening 146 until the intake door 302 is pushed open by water that flows into the body of pool cleaner 100*a* under hydraulic pressure in the body of pool cleaner 100*a*.

Grip opening 308 is an opening or groove at the bottom of base 120 facing the floor of the pool, for providing a better grip while holding the pool cleaner 100*a*. In at least one embodiment, grip opening 308 is close to the end of base 120 that is pivotally connected to head 110. In other embodiments, grip opening 308 may be located in other places.

Filter housing 310 is formed by four side walls, two of which protrude from the walls 144*a* and 144*b* inside the base 120 toward the head 110, connected by another two side walls that are close to the sides of base 120. In at least one embodiment, filter housing 310 meets with the intake opening 146 between the walls 144*a* and 144*b*. In at least one embodiment, filter 215 wraps around the outside of filter housing 310 for filtering the water that flows through the body of pool cleaner 100*a*. In at least one embodiment, door frame 214 is inserted into the filter housing 310 and is held in place by tabs 216, while intake door 302 covers the intake opening 146 until the intake door 302 is pushed open by water that flows through the intake opening 146 into the body because of hydraulic pressure. In other embodiments, filter housing 310 may include other shapes and/or structures.

Receiving portions 312 include panels protruding from the walls 144*a* or 144*b*, located adjacent to the filter housing for engaging the tabs 216. In at least one embodiment, the tail portions of the tabs 216 fits in the receiving portions 312, so as to hold and lock tabs 216 in the receiving portions 312. In at least one embodiment, each of receiving portions 312 includes a slot from inside, into which a hook or clasp portion at the end of tail portion of the tab is inserted that locks the tab in the receiving portion. In other embodiments, other numbers and/or types of fasteners may be substituted for the tabs 216 and receiving portions 312.

Screen 314 is a screen that covers the opening at the bottom of base 120 that is blocked by the quick drain door 124, preventing debris within the body of pool cleaner 100*a* from flowing back into the pool. Screen 314 may be a fine or coarse filter. In an embodiment, screen 314 is removable for easy replacement and cleaning. In at least one embodiment, the quick drain door 124 and screen 314 allow water in pool cleaner 100*a* to be emptied, so that it is easier to carry pool cleaner 100*a*.

Figure 3B:
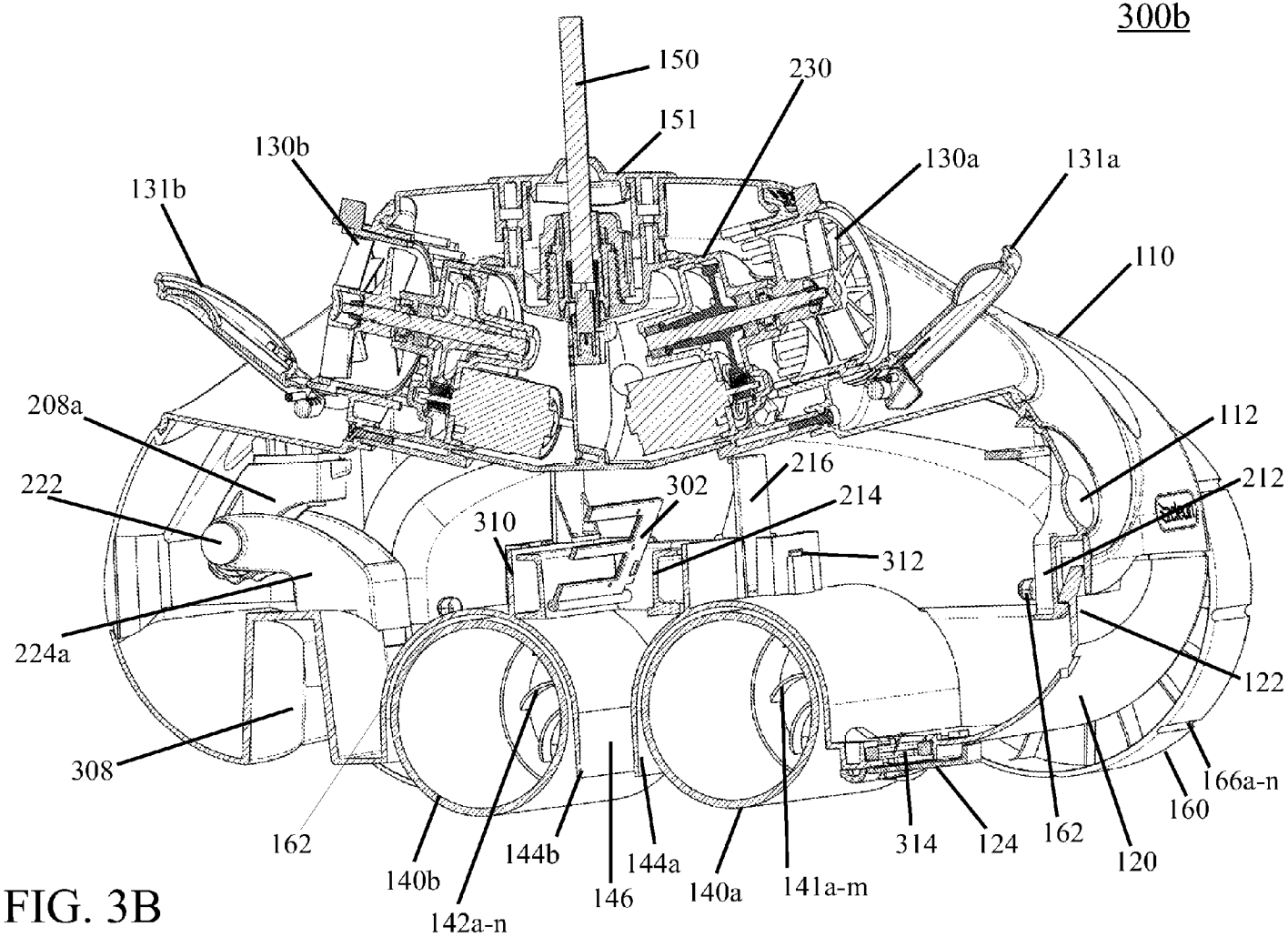
FIG. 3B shows another cross-sectional view of an embodiment of the pool cleaner of FIG. 1A.

FIG. 3B shows another cross-sectional view 300*b* of an embodiment of the pool cleaner 100*a* of FIG. 1A. FIG. 3B includes head 110, base 120, pumps 130*a* and 130*b*, flaps 131*a* and 131*b*, rollers 140*a* and 140*b*, spokes 141*a-m* and 142*a-n*, walls 144*a* and 144*b*, intake opening 146, power cord 150, cap 151, wheels 160, wheel axles 162, fastener 112, receiving portion 122, quick drain door 124, and grooves 166*a-n*, which were discussed in conjunction with FIGS. 1A and 1B. FIG. 3B also includes supporting members 208*a*, hook 212, door frame 214, tabs 216, pivots 222, pivot mount 224*a*, pump assembly 230, and roller axles 242*a* and 242*b*, which were discussed in conjunction with FIG. 2. FIG. 3B further includes door 302, spring 304, grip opening 308, filter housing 310, receiving portions 312, and screen 314, which were discussed in conjunction with FIG. 3A. In other embodiments, the assembly of FIG. 3B may not have all of the elements or features listed and/or may have other elements or features instead of or in addition to those listed.

FIGS. 3A and 3B may be two different views of the same embodiment. FIG. 3B shows another cross sectional view of pool cleaner 100*a* with both flaps 131*a* and 131*b* opened and the intake door 302 opens toward the head 110, and optionally includes two slots formed by a slat that crosses the middle of intake door 302. Alternatively, intake door 302 has no slots (and is one solid piece of material that block the flow of water or has a different number of slots and slats. The slats of intake door 302 may support a piece of material that blocks water flow, so that intake door 302 acts as valve—as a result of the piece of material blocking the flow of water, water flowing into pool cleaner 100*a*, while intake door 302 is open, does not leave pool cleaner 100*a* while intake door 302 is closed.

Figure 4A:
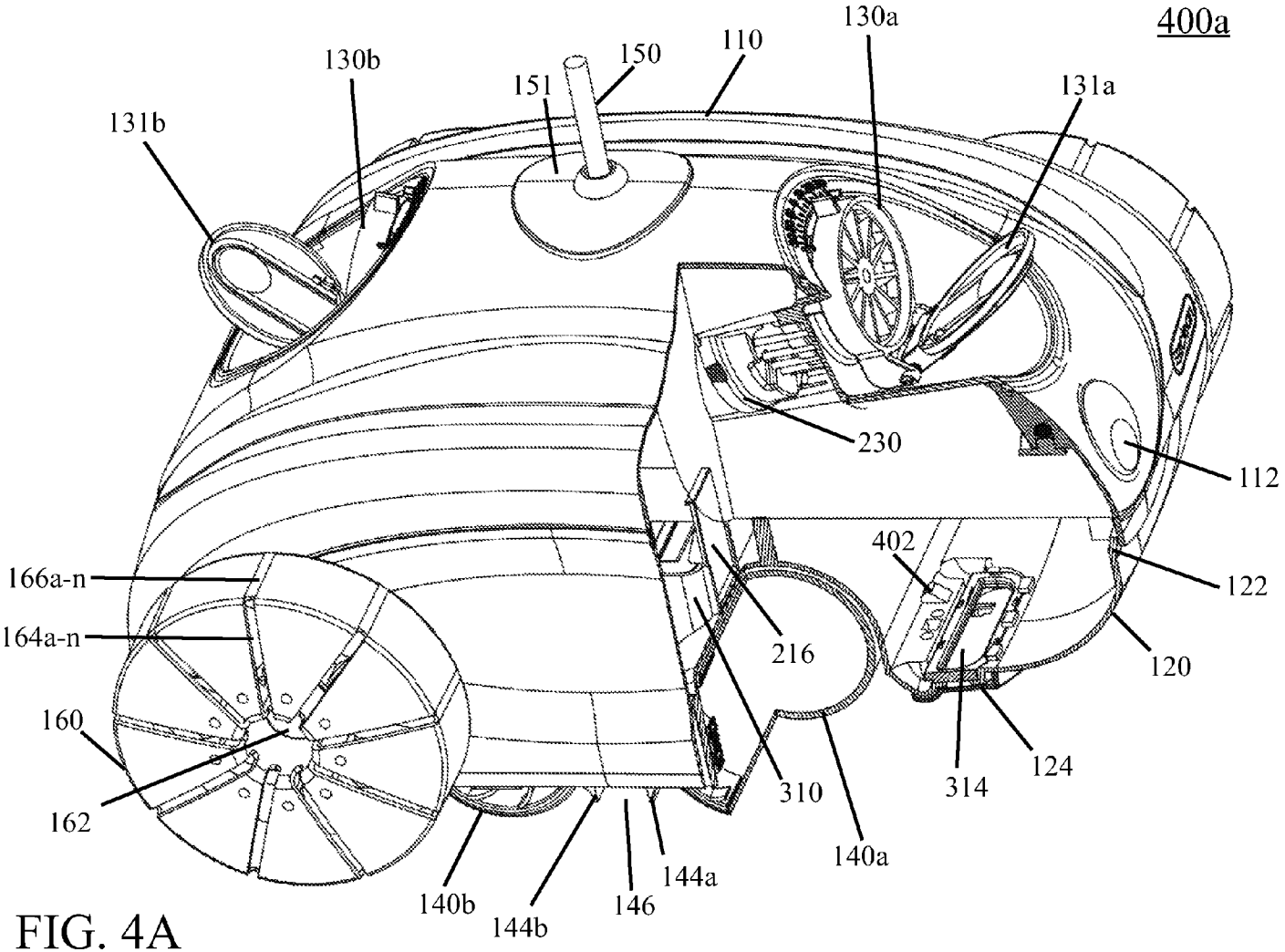
FIG. 4A shows a view of an embodiment of the pool cleaner of FIG. 1A with a portion of the pool cleaner cut open.

FIG. 4A shows a view 400*a* of an embodiment of the pool cleaner 100*a* of FIG. 1A, with a portion of the pool cleaner 100*a* cut open. FIG. 4A includes head 110, base 120, pumps 130*a* and 130*b*, flaps 131*a* and 131*b*, rollers 140*a* and 140*b*, walls 144*a* and 144*b*, intake opening 146, power cord 150, cap 151, wheels 160, wheel axles 162, slits 164*a-n*, fastener 112, receiving portion 122, quick drain door 124, and grooves 166*a-n*, which were discussed in conjunction with FIGS. 1A and 1B. FIG. 4A also includes pump assembly 230 and tabs 216, which were discussed in conjunction with FIG. 2. FIG. 4A further includes filter housing 310 and screen 314, which were discussed in conjunction with FIG. 3A. FIG. 4A may further include a protrusion 402. In other embodiments, the assembly of FIG. 4A may not have all of the elements or features listed and/or may have other elements or features instead of or in addition to those listed.

FIG. 4A shows a view 400*a* of an embodiment of the pool cleaner 100*a* with a portion of the head 110, base 120 and roller 140*a* cut open. FIG. 4A shows that pump 130*a* is tilted upwards, facing the discharge opening 202*a*. FIG. 4A also shows that roller 140*a* is located in the walls 144*a*, having a limited space between the roller 140*a* and the walls 144*a*.

Protrusion 402 is a protrusion from the inside of the base 120 toward the head 110, adjacent to the opening that is covered by the quick drain door 124. In at least one embodiment, protrusion 402 forms a groove from outside of the base 120 facing the floor of the pool, for holding a spring that biases the quick drain door 124 to stay closed and cover the opening.

Figure 4B:
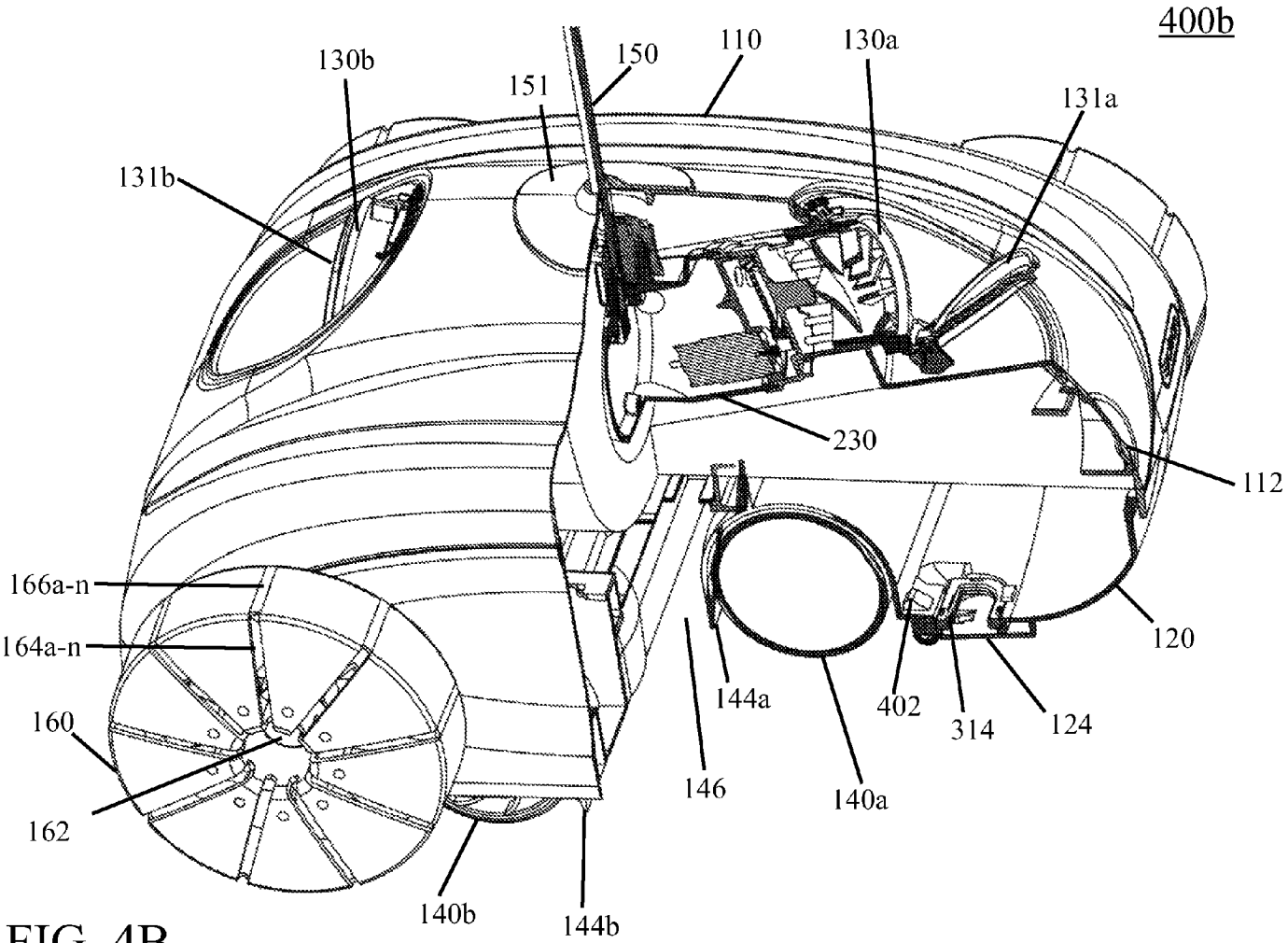
FIG. 4B shows a view of an embodiment of the pool cleaner of FIG. 1A with a portion of the pool cleaner cut open.

FIG. 4B shows a view 400*b* of an embodiment of the pool cleaner 100*a* of FIG. 1A with a cross-sectional view of a portion of the pool cleaner 100*a*. FIG. 4B includes head 110, base 120, pumps 130*a* and 130*b*, flaps 131*a* and 131*b*, rollers 140*a* and 140*b*, walls 144*a* and 144*b*, intake opening 146, power cord 150, cap 151, wheels 160, wheel axles 162, slits 164*a-n*, fastener 112, quick drain door 124, and grooves 166*a-n*, which were discussed in conjunction with FIGS. 1A and 1B. FIG. 4B also includes pump assembly 230 which was discussed in conjunction with FIG. 2. FIG. 4B further includes filter housing 310 and screen 314, which were discussed in conjunction with FIG. 3A. FIG. 4B also includes protrusion 402 which was discussed in conjunction with FIG. 4A. In other embodiments, the assembly of FIG. 4B may not have all of the elements or features listed and/or may have other elements or features instead of or in addition to those listed.

FIG. 4B shows the view 400*b* of pool cleaner 100*a* including cross-sectional view of pump 130*a*, a part of pump assembly 230, roller 140*a*, walls 144*a*, screen 314, and quick drain door 124. The elements of the pump 130*a* and pump assembly 230 were discussed in detail in conjunction with U.S. patent application Ser. No. 14/551,894. FIG. 4B also shows a cross-sectional view of a portion of the pump assembly 230, which was discussed in U.S. patent application Ser. No. 14/551,894.

Figure 5:
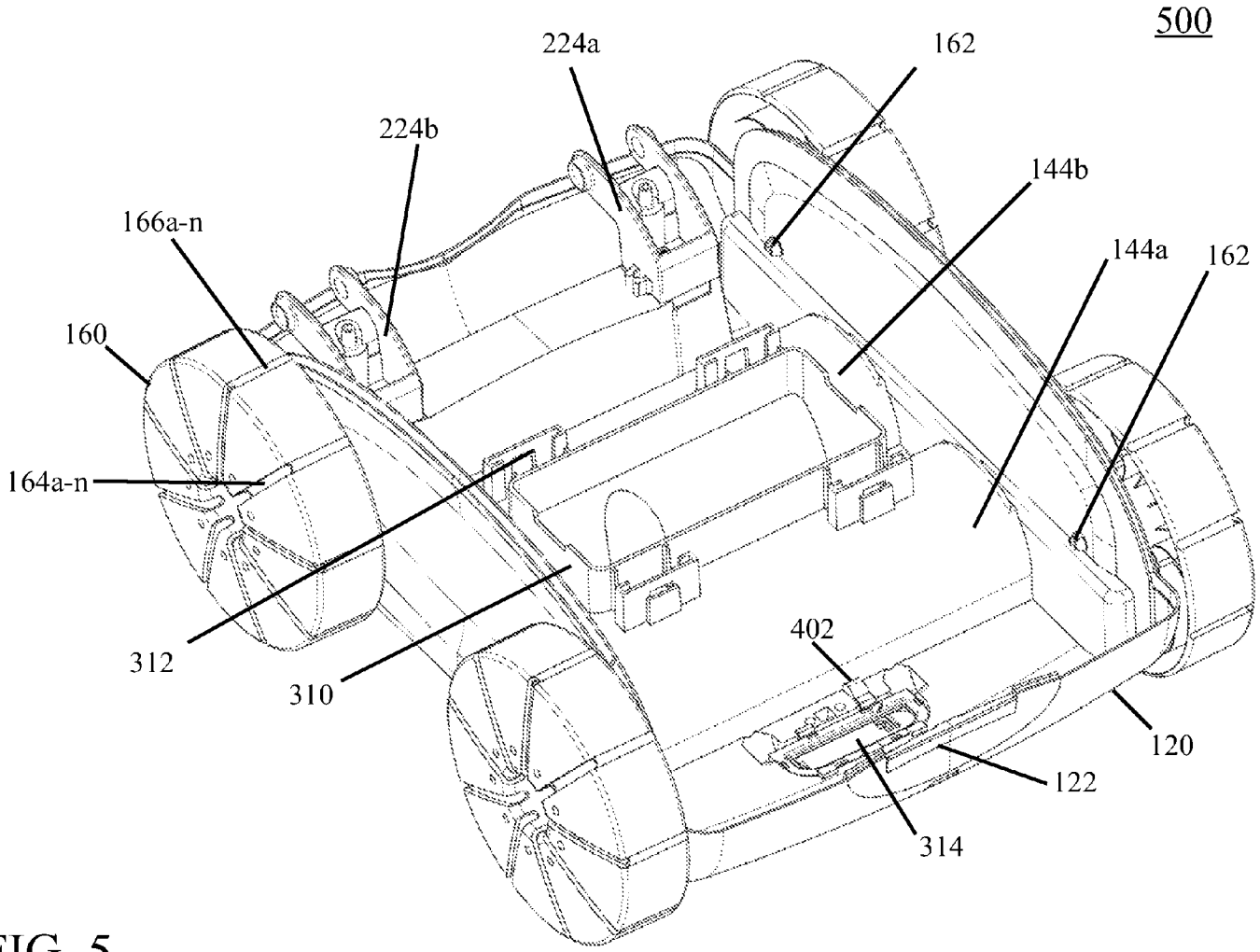
FIG. 5 shows a top view of an embodiment of the base and wheels of the pool cleaner of FIG. 1A.

FIG. 5 shows a top view 500 of an embodiment of the base 120 and wheels 160 of the pool cleaner 100*a* of FIG. 1A. FIG. 5 includes base 120, walls 144*a* and 144*b*, wheels 160, wheel axles 162, slits 164*a-n*, receiving portion 122, and grooves 166*a-n*, which were discussed in conjunction with FIGS. 1A and 1B. FIG. 5 also includes pivot mount 224*a*, which was discussed in conjunction with FIG. 2. FIG. 5 also includes filter housing 310, receiving portions 312, and screen 314, which were discussed in conjunction with FIG. 3A. FIG. 5 also includes protrusion 402 which was discussed in conjunction with FIG. 4A. In other embodiments, the assembly of FIG. 5 may not have all of the elements or features listed and/or may have other elements or features instead of or in addition to those listed.

FIG. 5 shows the top view 500 of base 120 including the two parallel walls 144*a* and 144*b* located close to the middle of base 120. In FIG. 5, the side walls of filter housing 310 protrude from the walls 144*a* and 144*b* for enclosing door frame 214. FIG. 5 also shows four receiving portions 312 for engaging tabs 216 that hold door frame 214 inside filter housing 310. FIG. 5 further shows four wheels 160 connected to the corners of base 120 via wheel axles 162.

Figure 6:
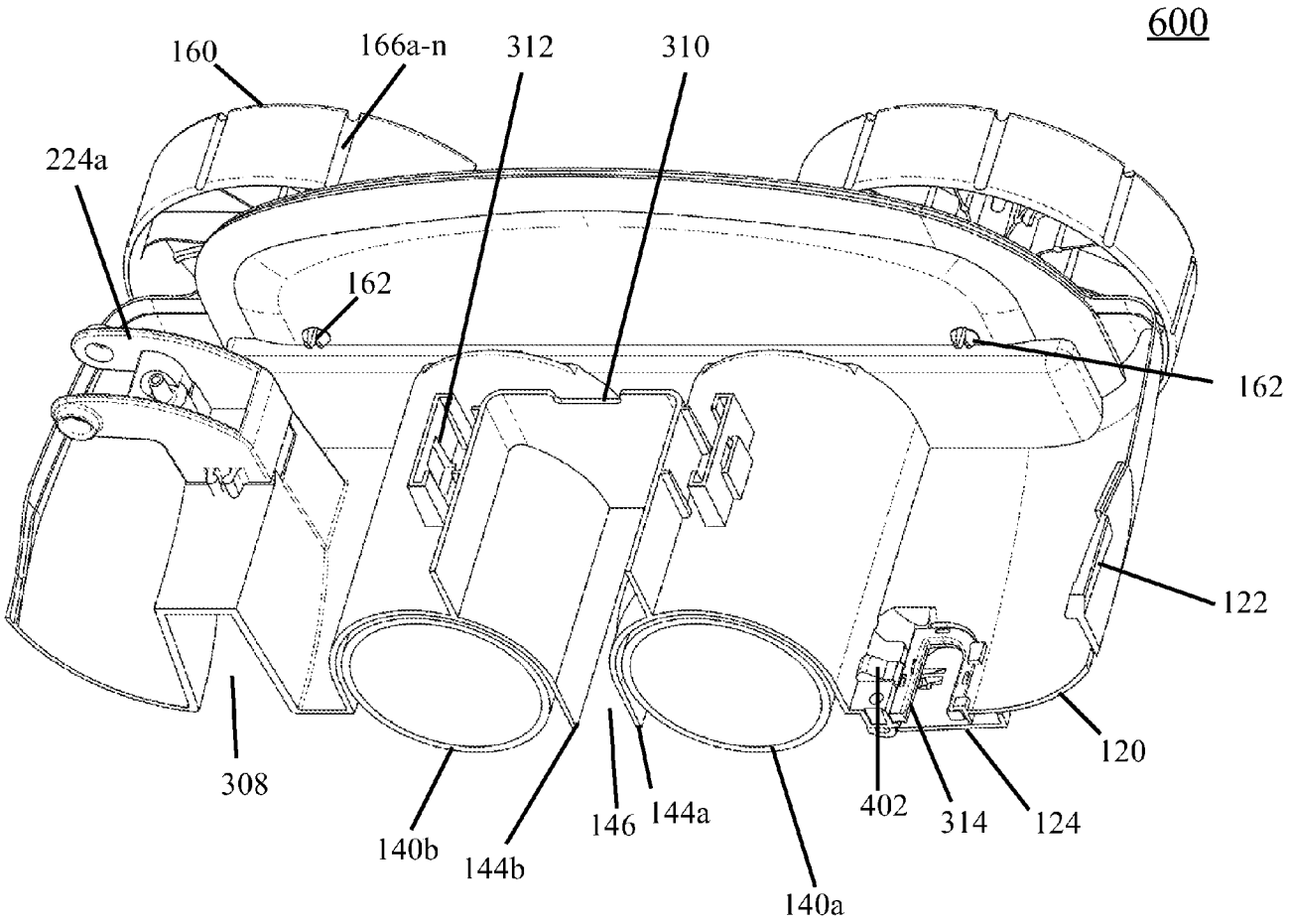
FIG. 6 shows a view of an embodiment of the base and rollers of a cut open portion of the pool cleaner of FIG. 1A.

FIG. 6 shows a view 600 of an embodiment of the base 120 and rollers 140 of a cut open portion of the pool cleaner 100*a* of FIG. 1A. FIG. 6 includes base 120, rollers 140*a* and 140*b*, walls 144*a* and 144*b*, intake opening 146, wheels 160, wheel axles 162, receiving portion 122, quick drain door 124, and grooves 166*a-n*, which were discussed in conjunction with FIGS. 1A and 1B. FIG. 6 also includes pivot mount 224*a*, which was discussed in conjunction with FIG. 2. FIG. 6 also includes filter housing 310, receiving portions 312, and screen 314, which were discussed in conjunction with FIG. 3A. FIG. 6 also includes protrusion 402 which was discussed in conjunction with FIG. 4A. In other embodiments, the assembly of FIG. 6 may not have all of the elements or features listed and/or may have other elements or features instead of or in addition to those listed.

FIG. 6 shows that rollers 140*a* and 140*b* are located in the walls 144*a* and 144*b*, respectively. In FIG. 6, the space between rollers and walls are minimized to prevent water from flowing around the rollers 140*a* and 140*b* into the cleaning path that is between the rollers 140*a* and 140*b*.

Figure 7:
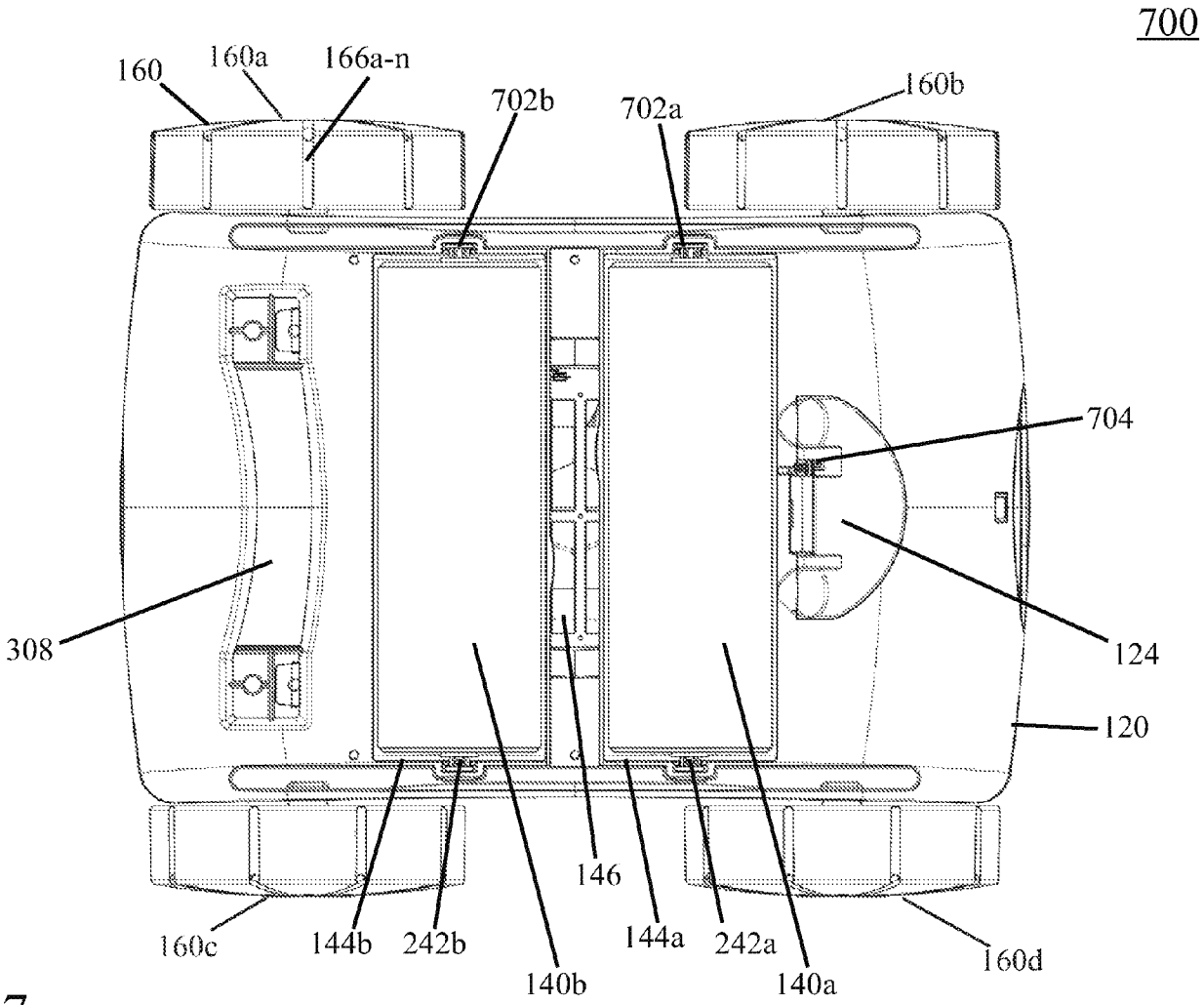
FIG. 7 shows a bottom view of an embodiment of the pool cleaner of FIG. 1A.

FIG. 7 shows a bottom view 700 of an embodiment of the pool cleaner 100*a* of FIG. 1A. FIG. 7 includes base 120, rollers 140*a* and 140*b*, walls 144*a* and 144*b*, intake opening 146, wheels 160, which includes wheels 160*a* and 160*b* on one side and wheels 160*c* and 160*d* on the other side, quick drain door 124, and grooves 166*a-n*, which were discussed in conjunction with FIGS. 1A and 1B. FIG. 7 also includes roller axles 242*a* and 242*b*, which were discussed in conjunction with FIG. 2. FIG. 7 also includes grip opening 308, which was discussed in conjunction with FIG. 3A. FIG. 7 may further include roller axles 702*a* and 702*b*, and spring 704. In other embodiments, the assembly of FIG. 7 may not have all of the elements or features listed and/or may have other elements or features instead of or in addition to those listed.

FIG. 7 shows the bottom view 700 of an embodiment of pool cleaner 100*a*. In FIG. 7, the two rollers 140*a* and 140*b* are connected in walls 144*a* and 144*b*, while intake opening 146 is located between the walls 144*a* and 144*b*. In at least one embodiment, rollers 140*a* and 140*b* are parallel to each other, between which a path of flow of water into pool cleaner 100*a* is defined. In at least one embodiment, quick drain door 124 and grip opening 308 are located close to either side of the bottom of the base 120, away from each other. In an embodiment in which the axles of two wheels 160*a* and 160*b* are 9.63 inches apart, the axles of the two wheels 160*c* and 160*d* are also 9.63 inches.

Roller axles 702*a* and 702*b* are similar to roller axles 242*a* and 242*b* except that roller axles 702*a* and 702*b* are located at the other ends of rollers 140*a* and 140*b*, opposite to roller axles 242*a* and 242*b*, respectively. Also, roller axles 242*a* and 702*a* connect the roller 140*a* in the wall 144*a*, while roller axles 242*b* and 702*b* connect the roller 140*b* in the wall 144*b*.

Spring 704 is attached to an axle of quick drain door 124, mechanically biasing the quick drain door 124 to stay closed to cover the drain opening at the bottom of the base 120. When pool cleaner 100*a* is pulled out of the pool, the water inside the body pushes open the quick drain door and flows out of the body.

Method of Use

Figure 8A:
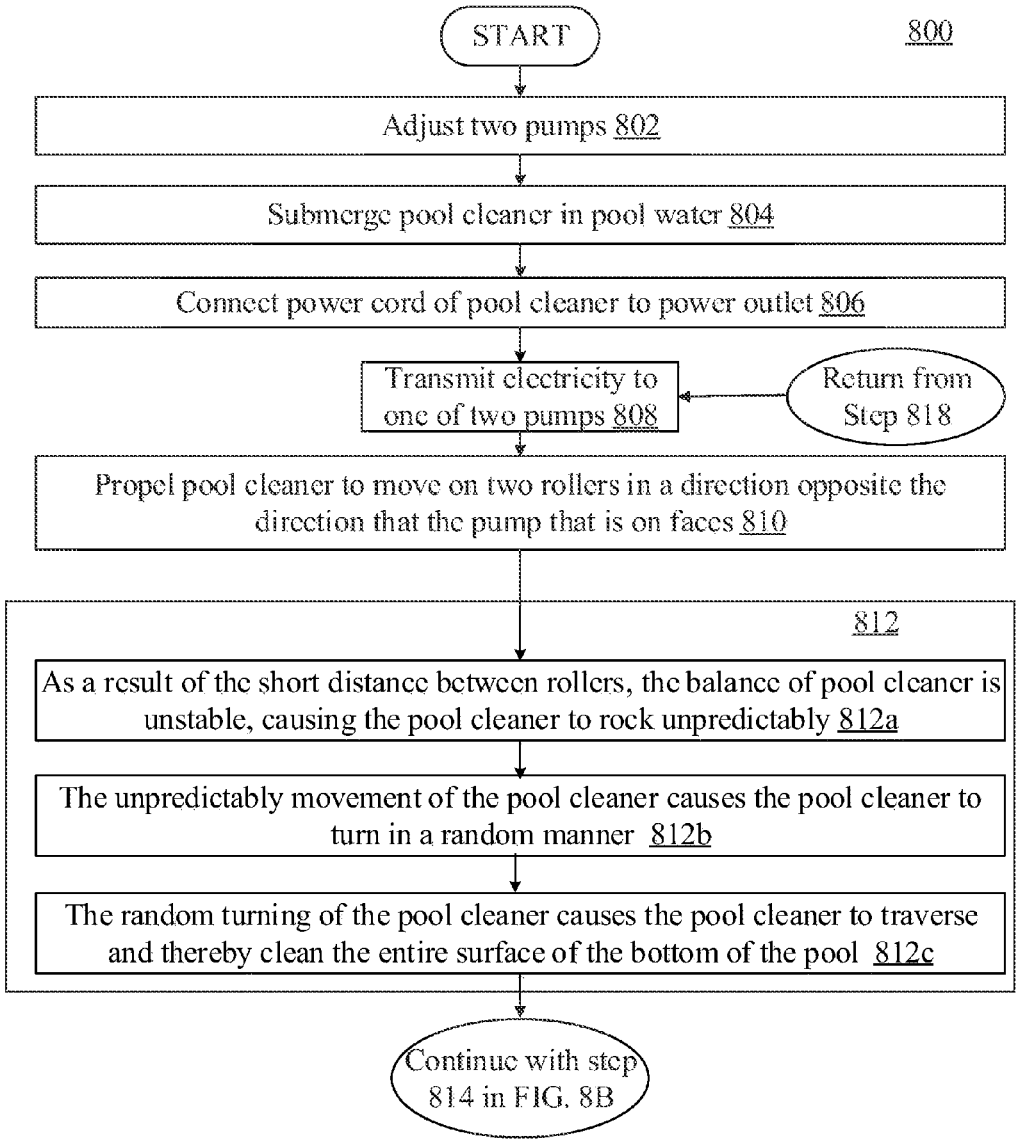
FIGS. 8A and 8B is a flowchart of an embodiment of a method of using the pool cleaner of FIG. 1A.
Figure 8B:
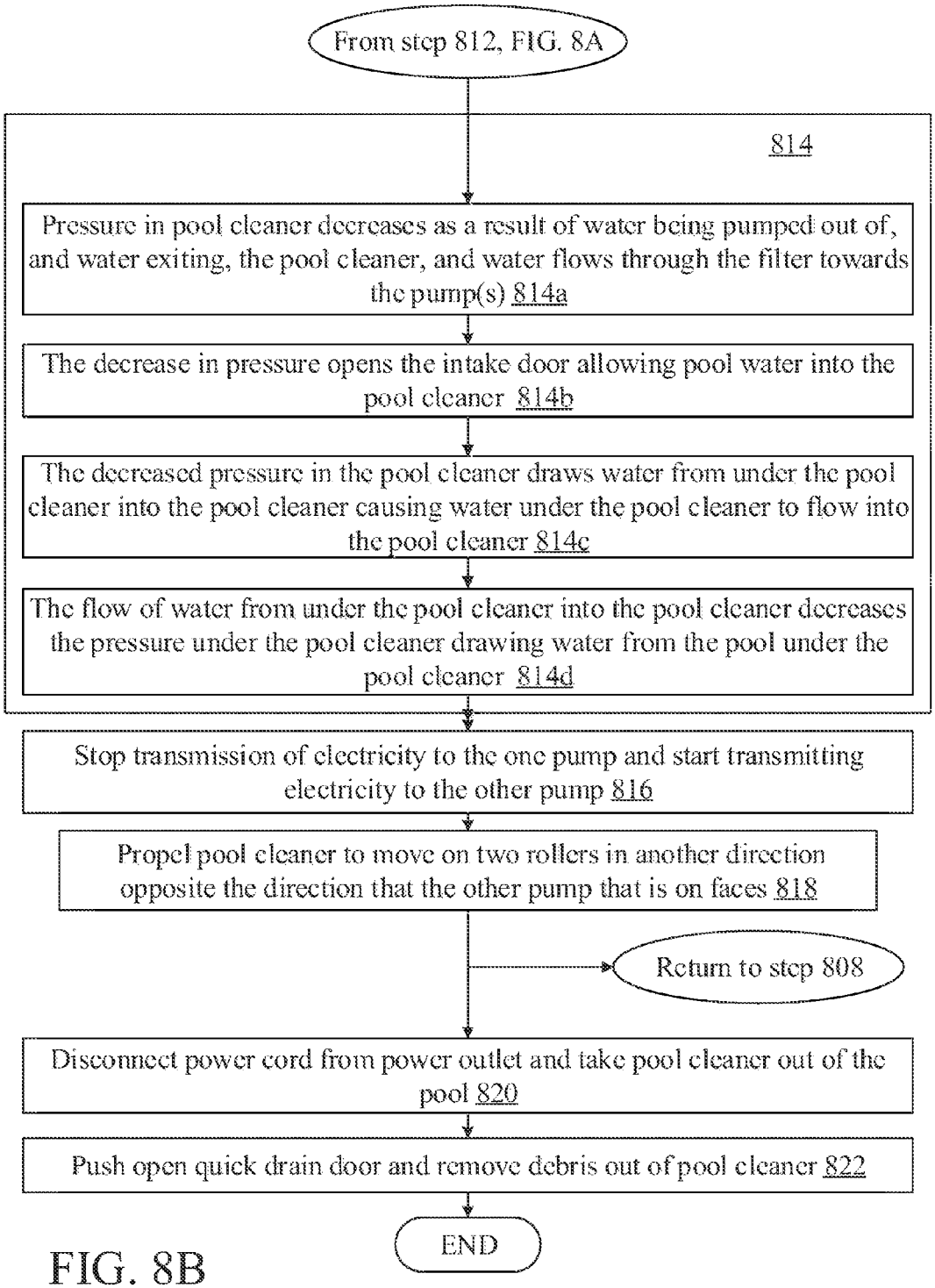

FIGS. 8A and 8B shows a flowchart of an embodiment of a method 800 of using the pool cleaner 100*a* of FIG. 1A. Steps 802-812 of method 800 are in FIG. 8A and steps 814-822 of method 800 are in FIG. 8B.

Starting with FIG. 8A, in step 802, the two pumps 130*a* and/or 130*b* are adjusted. In at least one embodiment, step 802 includes adjusting the rotational angles of the portions to which flaps 131*a* and/or 131*b* are connected, respectively, in order to adjust the direction of movements of the pool cleaner 100*a*. Step 802 may also include adjusting the angles to which the flaps 131*a* and 131*b* may be opened, respectively, in order to adjust the speed of the movements of the pool cleaner 100*a*. Optionally, step 802 may include adjusting the settings in a controller that determines the duration of time that each pump should remain on prior to switching directions and/or how long to keep the pool cleaner 100*a* moving before shutting off the pool cleaner 100*a*. Methods of adjusting the two pumps 130*a* and/or 130*b* were discussed in conjunction with U.S. patent application Ser. No. 14/551,894. Step 802 may be performed just once after purchasing pool cleaner 100*a*, for example. Afterwards, pool cleaner 100*a* may be used without setting flaps 131*a* and 131*b* or the controller.

In step 804, the pool cleaner 100*a* is submerged in pool water.

In step 806, the power cord 150 is connected to a power outlet at the end that is not connected to the pool cleaner 100*a*.

In step 808, electricity is transmitted to one of the two pumps 130*a* and 130*b*, which may be determined by the controller. In one embodiment, electricity is transmitted to the motor of pump 130*a* (for example) in order to rotate the propeller that is connected to the pump 130*a*. Alternatively, step 808 may include transmitting electricity to the motor of pump 130*b* to rotate the propeller that is connected to the pump 130*b*. In at least one embodiment, the pumps 130*a* and 130*b* are activated alternatively, one at a time each pump propelling pool cleaner 100*a* in a different direction.

In step 810, as a result of the rotation of the propeller that is connected to pump 130*a*, water inside the body of pool cleaner 100*a* is pushed out of the discharge opening 202*a* and the flap 131*a* is pushed open. Water exiting the discharge opening 202*a* may bounce against the flap 131*a* and creates propulsion for moving the pool cleaner 100*a* in a direction that is proximately opposite to the flow of water that has bounced off the flap 131*a*. Meanwhile, the flap 131*b* is closed due to the pressure inside the body of pool cleaner 100*a* being lower than the outside water. In at least one embodiment, the propulsion force on the body cases the two rollers 140*a* and 140*b* to rotate on which the body of pool cleaner 100*a* moves.

In optional step 812, pool cleaner 100*a* traverses the floor in a rocking motion, with at least one of the wheels 160 come in contact with the floor from time to time. Optionally as part of step 812, pool cleaner 100*a* travels on two rollers 140*a* and 140*b* that are close to each other. Thus pool cleaner 100*a* is unstable as a result of the short wheelbase (between rollers 140*a* and 140*b*) and/or high center of gravity of pool cleaner 100*a*. Optionally, as part of step 812, pool cleaner 100*a* rocks or tilts as a result of external forces such as the force from water hitting the forward portion of pool cleaner 100*a* as pool cleaner 100*a* travels, forces resulting from water currents, forces from pool cleaner 100*a* being shaken as a result of traveling on an uneven floor or traveling over or into obstacles. When pool cleaner 100*a* rocks or tilts, one or some of the wheels 160 may come in contact with the floor temporarily and prevent the pool cleaner 100*a* from tipping over. Optionally as part of step 812, after touching the ground for a limited time, the one or some of the wheels 160 may be off the ground again. Alternatively, optional step 812 may include turning pool cleaner 100*a* about a wheel that is in contact with the floor until the wheel is off the ground. Step 812 may include sub-steps 812*a-c*. In sub-step 812*a*, as a result of the short distance between rollers 146*a* and 146*b*, the balance of pool cleaner is unstable, causing the pool cleaner to rock unpredictably. In sub-step 812*b*, the unpredictably movement of the pool cleaner causes the pool cleaner to turn in a random manner. In sub-step 812*c*, the random turning of the pool cleaner causes the pool cleaner to traverse and thereby clean the entire surface of the bottom of the pool. Sub-step 812*c* is the last step of method 800 that is on FIG. 8A.

Continuing the description of method 800, with FIG. 8*b*, in step 814, concurrent with and as a result of the water leaving the pool cleaner 100*a* in step 810, the pressure is lowered inside the pool cleaner 100*a*, which draws water into the body of pool cleaner 100*a*. Step 814 may be divided into sub-steps 814*a-c*. In at least one embodiment, in sub-step 814*a*, pressure in pool cleaner decreases as a result of water being pumped out of, and water exiting, the pool cleaner 100*a*, and water flows through the filter 215 towards the pump or pumps that are on, and the pressure decreases inside the body of pool cleaner 100*a*. In sub-step 814*b*, the decrease in pressure opens the intake door 302 allowing pool water into the pool cleaner 100*a*. In sub-step 814*c*, the decreased pressure in the pool cleaner 100*a* draws water from under the pool cleaner 100*a* into the pool cleaner 100*a* causing water under the pool cleaner to flow into the pool cleaner 100*a*. In sub-step 814*d*, the flow of water from under the pool cleaner 100*a* into the pool cleaner 100*a* decreases the pressure under the pool cleaner 100*a* drawing water from the pool under the pool cleaner 100*a*. The presence of the rollers 140*a* and 140*b* restricts the cross sectional area through which water can flow to get to the intake of pool cleaner 100*a*, which increases the velocity of the water flowing between the rollers 140*a* and 140*b* compared to the water outside of pool cleaner 100*a*. In sub-step 814*c*, as a result of the lower pressure, pool water from the sides of the pool cleaner 100*a* is drawn into the path between the rollers 140*a* and 140*b*, from which the water may be drawn through intake opening 146 and into the body of pool cleaner 100*a*.

In step 815, as a result of step 814, as the water flows through the pool cleaner 100*a*, the water pushes open intake door 302 and is forced through filter 215 that obstructs the flow of water through the pool cleaner 100*a*. Debris is removed from pool water as the pool water is filtered as a result of the water flowing through the filter 215 inside the body of pool cleaner 100*a*.

In step 816, the controller determines that the duration of time for which pump 130*a* is kept on has ended, and the transmission of electricity to pump 130*a* is stopped. Optionally, if the duration of time for powering each pump varies, the controller determines the duration of time that pump 130*b* is to be powered. Then, under the control of the controller, electricity is transmitted to pump 130*b* and the propeller that is connected to pump 130*b* starts to rotate. The determination of the duration of time for which the pump is kept on was discussed in conjunction with U.S. patent application Ser. No. 14/551,894.

In step 818, as a result of the rotation of propeller that is connected to the pump 130*b*, water inside the body of pool cleaner 100*a* is pushed out of the discharge opening 202*b*, and flap 131*b* is pushed open. Water exiting the discharge opening 202*b* bounces against flap 131*b* and creates propulsion for moving the pool cleaner 100*a* in a direction that is proximately opposite to the flow of water that has bounced off flap 131*b*. Meanwhile, flap 131*a* is closed due to the negative pressure inside the body of pool cleaner 100*a*. Step 818 is essentially the same as step 810. The only difference is which pump is on and which pump is off and the resulting flow of the water.

Steps 808-818 are repeated until the user stops the process. Alternatively, the controller may have a user adjustable setting for ending the process and shutting off both pumps 130*a* and 130*b*.

In step 820, the power cord 150 is disconnected from the power outlet, and the pool cleaner 100*a* is taken out of the pool. In at least one embodiment, a user may pull the power cord 150 to get the pool cleaner 100*a* out of the pool.

In step 822, debris is removed out of the filter 215 of pool cleaner 100*a*, optionally by releasing the fastener 112 of head 110 to open the pool cleaner 100*a* and removing the filter 215 for cleaning. Optionally, step 822 may include, after pool cleaner 100*a* is taken out of the pool, the quick drain door 124 at the bottom of the pool cleaner 100*a* is pushed open by the water that flows out of the body of pool cleaner 100*a*.

In an embodiment, each of the steps of method 800 is a distinct step. In another embodiment, although depicted as distinct steps in FIGS. 8A and 8B, steps 802-822 may not be distinct steps. In other embodiments, method 800 may not have all of the above steps and/or may have other steps in addition to or instead of those listed above. The steps of method 800 may be performed in another order. Subsets of the steps listed above as part of method 800 may be used to form their own method.

Method of Assembly

Figure 9:
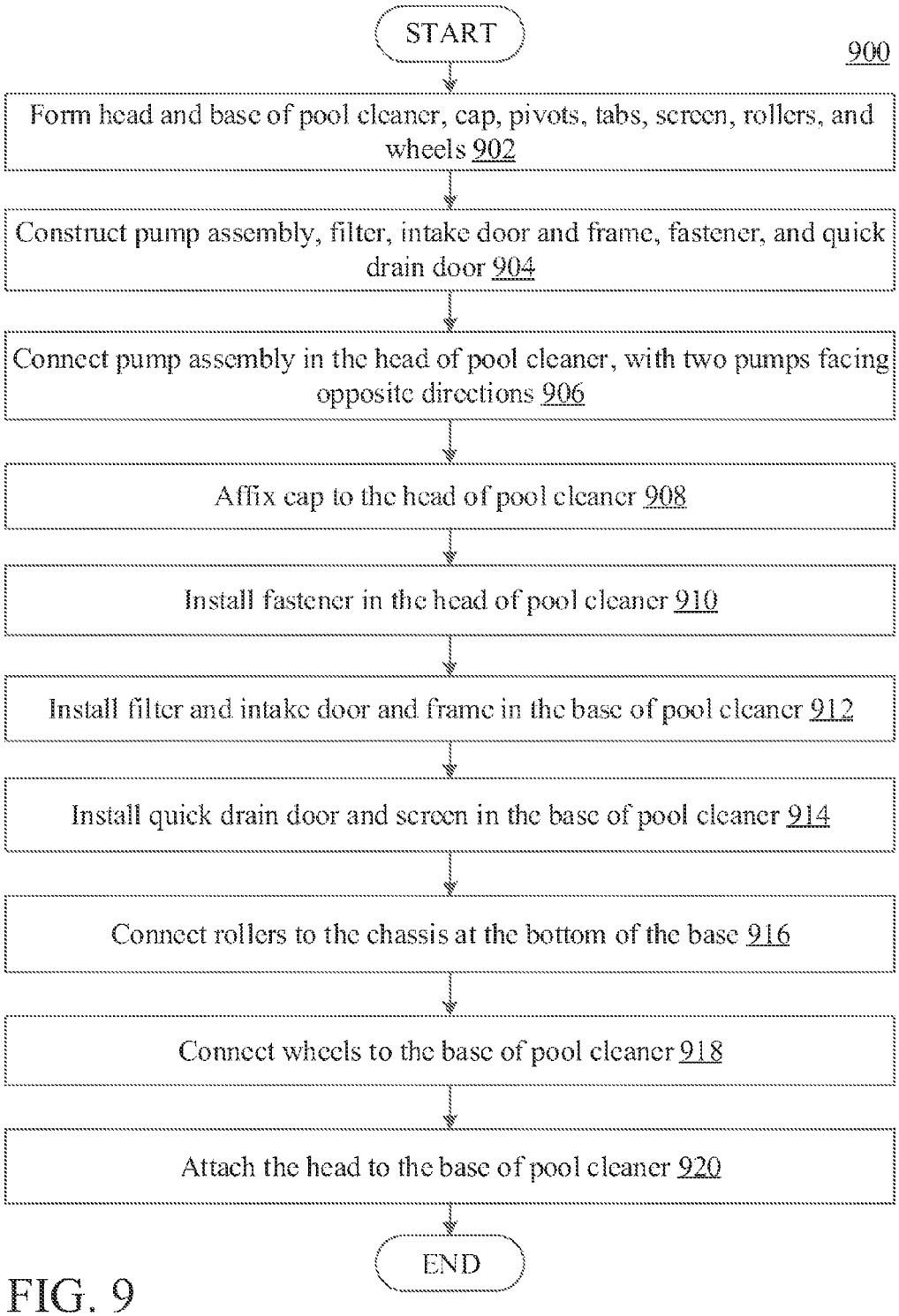
FIG. 9 is a flowchart of an embodiment of a method of making the pool cleaner of FIG. 1A.

FIG. 9 is a flowchart of an embodiment of a method 900 of making the pool cleaner 100*a* of FIG. 1A.

In step 902, head 110 and base 120 of the pool cleaner 100*a* are formed. As part of step 902, the cap 151, pivots 222, screen 314, tabs 216, rollers 140*a* and 140*b*, and wheels 160 are formed. As part of step 902, the walls and parts of pump assembly 230 are also formed.

In step 904, pump assembly 230 including two pumps 130*a* and 130*b* are assembled, which was discussed in conjunction with U.S. patent application Ser. No. 14/551,894. As part of step 902, flaps 131*a* and 131*b* are pivotally connected to the pumps 130*a* and 130*b*, to cover the discharge ends of the pumps 130*a* and 130*b*, respectively. As part of step 902, filter 215 is assembled. As part of step 902, fastener 112 and quick drain door 124 are also assembled. As part of step 902, door frame 214 with intake door 302 are assembled.

In step 906, pump assembly 230 is affixed in the head 110 of pool cleaner 100*a*, with the two pumps 130*a* and 130*b* located in the discharge openings 202*a* and 202*b*, respectively, both tilted upwards facing opposite directions.

In step 908, cap 151 is affixed to the head 110 with the power cord 150 going out of head 110 through opening 204 and further through a hole in cap 151.

In step 910, fastener 112 is installed in the head 110 of pool cleaner 100*a*, which may engage the receiving portion in the base 120 for locking the head 110 and base 120 together. Alternatively, fastener 112 may be installed in the base 120 for engaging a receiving portion in the head 110.

In step 912, filter 215 is installed in the base 120 of pool cleaner 100*a*. As part of step 912, the door frame 214 is fitted into filter housing 310 with the intake door 302 covering the intake opening 146. As part of step 912, tabs 216 are inserted into the receiving portions 312 and hold the door frame 214 in the filter housing 310.

In step 914, quick drain door 124 is installed at the opening at the bottom of the base 120 of pool cleaner 100*a*.

As part of step 914, screen 314 is installed in the opening for preventing debris from falling back to the pool.

In step 916, rollers 140*a* and 140*b* are installed in the walls 144*a* and 144*b* at the bottom of the base 120, respectively.

In step 918, wheels 160 are connected to the corners of base 120.

In step 920, the head 110 is attached to the base 120 to form the pool cleaner 100*a*. In at least one embodiment, the head 110 may be pivotally connected to the base 120 and may be locked, via fastener 112.

In an embodiment, each of the steps of method 900 is a distinct step. In another embodiment, although depicted as distinct steps in FIG. 9, steps 902-920 may not be distinct steps. In other embodiments, method 900 may not have all of the above steps and/or may have other steps in addition to or instead of those listed above. The steps of method 900 may be performed in another order. Subsets of the steps listed above as part of method 900 may be used to form their own method.

Alternatives and Extensions

In an alternative embodiment, pool cleaner 100*a* maybe battery powered. In an embodiment, a power supply may be carried within pool cleaner 100*a*, and pool cleaner 100*a* may not have a power cord 150. In an alternative embodiment, instead of always keeping one of pumps 130*a* and 130*b* off and the other on, and alternating which is off and which is on to change directions, both pumps 130*a* and 130*b* are always on. However, one of the two pumps 130*a* and 130*b* is set to a higher setting (e.g., by sending a higher current or by applying a higher voltage to that pump) than the other, so that there is a net force pushing the pool cleaner 100*a* in the opposite direction as the water discharging from the pump with the higher setting. Which pump has the higher setting is changed to change the direction of travel of the pool cleaner 100*a*.

Each embodiment disclosed herein may be used or otherwise combined with any of the other embodiments disclosed. Any element of any embodiment may be used in any embodiment.

Although the invention has been described with reference to specific embodiments, it will be understood by those skilled in the art that various changes may be made and equivalents may be substituted for elements thereof without departing from the true spirit and scope of the invention. In addition, modifications may be made without departing from the essential teachings of the invention. Although the invention has been described with reference to specific embodiments, it will be understood by those skilled in the art that various changes may be made and equivalents may be substituted for elements thereof without departing from the true spirit and scope of the invention. In addition, modifications may be made without departing from the essential teachings of the invention.

The invention claimed is:

1. A device comprising:

at least two rollers;

a body to which the at least two rollers are attached, the body resting on the at least two rollers when the device rests on a flat level surface with the flat surface extending lengthwise under an entirety of the body, the at least two rollers supporting the body when the device moves on the at least two rollers, the body including at least one intake opening at the bottom of the body between the at least two rollers, the at least two rollers and the bottom of the body forming a channel region for water to flow from outside the device, to between two rollers of the at least two rollers, one of the at least two rollers being on one side of the intake opening, and another of the two rollers of the at least two rollers being on another side of the intake opening, so that water passing into the intake opening passes between the two of the at least two rollers;

at least one pump assembly being affixed inside the body for drawing water through the intake opening into the body and pushing the water out of the body;

a filter for filtering out debris in the water;

a power source for providing electrical power to the pump assembly; and wherein the at least two rollers are spaced, so as to enhance a vacuum created by the pump, as compared to were the rollers further apart, and maintain a sufficient vacuum for picking up fine particles of debris from a pool floor, wherein the at least two rollers are spaced so that the device has an unstable balance when moving on the at least two rollers while all of the at least two rollers are on the flat level surface, simultaneously, so as to rock at least once every 100 feet.

2. The device of claim 1, wherein the distance between the bottom of the body and either of the at least two rollers is such that resistance to water flowing between the bottom of the body and either of the at least two rollers is greater than a resistance to water flow associated with other paths of possible water flow.

3. The device of claim 1, wherein the axles of the at least two rollers are parallel to each other.

4. The device of claim 1, the device being a pool cleaner, the pool cleaner having at least a combination of a height of a center of gravity and a distance between the at least two rollers that causes the device to be unstable when moving on the at least two rollers and tends to rock at least once every 100 feet when moving under water on the flat level surface.

5. The device of claim 4, wherein the device is unstable and rocks while traveling on the flat level surface, so as to randomly change directions of travel and clean an entire bottom surface of the pool floor.

6. The device of claim 1, further comprising at least one point on the body on which forces act to propel the device to move when the pump assembly is on, wherein the distance between the point and the axles of the at least two rollers is equal to or greater than the distance between the axles of the at least two rollers.

7. The device of claim 1, further comprising a plurality of wheels rotatably attached to the body of the device, each wheel having a bottom, each roller of the at least two rollers having a bottom, the body having a bottom, the plurality of wheels are attached to the body in a location that holds the bottoms of the plurality of wheels closer to the bottom of the body than the bottoms of the at least two rollers are to the bottom of the body.

8. The device of claim 1, further comprising a plurality of wheels, at least one of the plurality of wheels is connected to a corner of the body of the device, and is not in contact with the flat level surface when the device rests on the flat level surface.

9. The device of claim 8, wherein the plurality of wheels located in the corners being placed such that when the device is traveling and one of the plurality of wheels at the corners contact the floor, the one of the plurality of wheels at the corner serves as a pivot point around which the device turns.

10. The device of claim 1, wherein the pump assembly includes at least two pumps pointing in opposite directions, the two pumps each being associated with one of two discharge openings, each discharge opening being on a different side of the body.

11. The device of claim 1, wherein each of the at least one intake opening is located between two of the at least two rollers that are adjacent to each other, wherein the adjacent rollers have a length, the adjacent rollers and the bottom of the body form a path in which water flows from outside the device, to between the adjacent rollers, flowing parallel to the length of the adjacent rollers, into the intake opening between the adjacent rollers.

12. The device of claim 1, wherein an average density of the device is greater than or equal to the density of water.

13. The device of claim 1, wherein the body includes a head and a base that are pivotally attached at one end, allowing the head to open without detaching from the base; and wherein the body has a fastener on the other end, locking the head and the base together.

14. The device of claim 1, further comprising an intake door that is pivotally attached at the bottom of the body, the intake door being spring biased to cover the intake opening until being pushed open by water that flows through the intake opening into the body.

15. The device of claim 1, wherein the distance between the at least two rollers is less than half of a length of the body.

16. The device of claim 1, wherein the device has a front end and a back end;

an intake opening of the at least one intake openings is located between two rollers of the at least two rollers, and each of the two rollers of the at least two rollers is closer to the intake opening of at least one intake opening than to the front end of the device and each of the two rollers of the at least two rollers closer to the intake opening of the at least one intake opening than to the back end of the device.

17. A device comprising:

at least two rollers;

a body to which the at least two rollers are attached, the body resting on the at least two rollers when the device rests on a flat level surface, the at least two rollers supporting the body when the device moves on the at least two rollers, the body including at least one intake opening at the bottom of the body between the at least two rollers, the at least two rollers and the bottom of the body forming a path of water flow in which water flows from outside the device, to between the at least two rollers into the intake opening;

at least one pump assembly being affixed inside the body for drawing water through the intake opening into the body and pushing the water out of the body;

a filter for filtering out debris in the water;

a power source for providing electrical power to the pump assembly;

a plurality of wheels rotatably attached to the body of the device, each wheel having a bottom, each roller of the at least two rollers having a bottom, the body having a bottom, the plurality of wheels are attached to the body in a location that holds the bottoms of the plurality of wheels closer to the bottom of the body than the bottoms of the at least two rollers are to the bottom of the body;

wherein the device traverses a level floor in a rocking motion, wherein the plurality of wheels are located further away from the intake opening than the at least two rollers.

18. A method for using a device, comprising:

providing electrical power to the device, the device including at least two rollers, each of the two rollers being cylindrical;

a body to which the at least two rollers are attached, the body resting on the at least two rollers when the device rests on a flat level surface with the flat surface extending lengthwise under an entirety of the body, the at least two rollers supporting the body when the device moves on the at least two rollers, the body including at least one intake opening at the bottom of the body between the at least two rollers, the at least two rollers and the bottom of the body forming a path of water flow;

at least one pump assembly being affixed inside the body for drawing water through the intake opening into the body and pushing the water out of the body;

a filter for filtering out debris in water;

turning on the pump assembly;

drawing water by the pump assembly through the intake opening into the body of the device, water flowing from outside the device, to between the at least two rollers, entering parallel to the at least two rollers, into the intake opening;

filtering out debris by the filter; and wherein the at least two rollers are spaced so that in combination with the pump a vacuum is created sufficient for picking up fine particles of debris from a pool floor, wherein the at least two rollers are spaced so that the device has an unstable balance when moving on the at least two rollers while all of the at least two rollers are on the flat level surface, simultaneously, so as to rock at least once every ten minutes.

19. The method of claim 18, wherein the device rocks randomly, causing the device to turn randomly while traveling on the flat level floor, and the device automatically traverses an entire bottom surface of the pool floor as a result of the random turns.

20. A method for assembling a device, comprising attaching at least two rollers to a body of the device, each of the rollers being cylindrical, the body resting on the at least two rollers when the device rests on a flat level surface with the flat surface extending lengthwise under an entirety of the body, the at least two rollers supporting the body when the device moves on the at least two rollers, the body including at least one intake opening at the bottom of the body between the at least two rollers, the rollers and the bottom of the body forming a channel for water to flow in which water flows from outside the device, to between the at least two rollers, parallel to the rollers, into the intake opening;

affixing a pump assembly inside the body for drawing water through the intake opening into the body and pushing the water out of the body;

affixing a filter to the device for filtering out debris in water;

connecting a power cable to the pump assembly for providing electrical power to the pump assembly; and wherein the at least two rollers are spaced so that in combination with the pump the rollers create a vacuum sufficient for picking up fine particles of debris from a pool floor, wherein the at least two rollers are spaced so that the device has an unstable balance when moving on the at least two rollers while all of the at least two rollers are on the flat level surface, simultaneously.

21. A device, comprising at least two rollers, each roller of the at least two rollers being cylindrical;

a body to which the at least two rollers are attached, the body resting on the at least two rollers when the device rests on a flat level surface, the at least two rollers supporting the body when the device moves on the at least two rollers, the body including at least one intake opening at the bottom of the body between the at least two rollers, the at least two rollers and the bottom of the body forming a path of water flow in which water flows from outside the device, to between the at least two rollers, into the intake opening;

at least one pump assembly being affixed inside the body for drawing water through the intake opening into the body and pushing the water out of the body;

a filter for filtering out debris in the water;

a power source for providing electrical power to the pump assembly; and the bottom of the device having a plurality of semi-cylindrical channels, each channel of the plurality of channels housing one of the at least two rollers, each of the channels having a wall whose radius of curvature is larger than the radius of each roller housed within each of the channels, so that each of the roller turns freely within each of the channels, respectively, wherein the at least two rollers are spaced so that in combination with the pump create a vacuum sufficient vacuum for picking up fine particles of debris from a pool floor, wherein the bottom of the body is spaced from each roller of the at least two rollers so that resistances to water flow associated with paths of water flow that flow between any of the at least two rollers and the bottom of the body are greater than resistances to water flow associated with other paths of water flow that do not flow between the bottom of the body and the at least two rollers.

22. A device, comprising at least two rollers, each roller of the at least two rollers being cylindrical;

a body to which the at least two rollers are attached, the body resting on the at least two rollers when the device rests on a flat level surface, the at least two rollers supporting the body when the device moves on the at least two rollers, the body including at least one intake opening at the bottom of the body between the at least two rollers, the at least two rollers and the bottom of the body forming a path of water flow in which water flows from outside the device, to between the at least two rollers, entering parallel to the at least two rollers, into the intake opening;

at least one pump assembly being affixed inside the body for drawing water through the intake opening into the body and pushing the water out of the body;

a filter for filtering out debris in the water;

a power source for providing electrical power to the pump assembly; and the bottom of the device including at least a first semi cylindrical channel, the first semi-cylindrical channel housing a first roller of the at least two rollers;

the first semi-cylindrical channel having a wall whose radius of curvature is larger than the radius of the first roller, so that the first roller turns freely within the first semi-cylindrical channel;

the first roller being located in the first semi-cylindrical charmel so that the first semi-cylindrical channel is concentric to that first roller;

a second semi cylindrical channel, the second semi-cylindrical channel housing a second roller of the at least two rollers;

the second semi-cylindrical channel having a wall whose radius of curvature is larger than the radius of the second roller, so that the second roller turns freely within the second semi-cylindrical channel; and the second roller being located in the second semi-cylindrical channel so that the second semi-cylindrical channel is concentric to that second roller, wherein the at least two rollers are spaced so as to enhance a vacuum created by the pump, as compared to were the two rollers further apart, and maintain a sufficient vacuum for picking up fine particles of debris from a pool floor, wherein the bottom of the body is spaced from each roller of the at least two rollers so that resistances to water flow associated with paths of water flow that flow between any of the at least two rollers and the bottom of the body are greater than resistances to water flow associated with other paths of water flow that do not flow between the bottom of the body and the at least two rollers.

23. The device of claim 22, the at least two semi-cylindrical rollers having a length; the device further comprising:

a first extension wall that is parallel to the length of the first semi-cylindrical channel, the first extension wall extending down from one end of the first semi-cylindrical channel, away from the bottom of the pool cleaner, the first extension wall blocking flow of water exiting from between the first roller and the first semi-cylindrical channel;

a second extension wall that is parallel to the length of the second semi-cylindrical channel, the second extension wall extending down from one end of the second semi-cylindrical channel, away from the bottom of the pool cleaner, the second extension wall blocking flow of water exiting from between the second roller and the second semi-cylindrical channel.

24. The device of claim 22, further including the first semi-cylindrical channel sharing a first wall with the intake opening; and the second semi-cylindrical channel sharing a second wall with the intake opening.

25. The device of claim 22, further including a surface of the first semi-cylindrical roller being a distance of less than 0.5 mm from a surface of the first roller, so as to restrict a flow of water between the first semi-cylindrical channel and the first roller; and a surface of the second semi-cylindrical roller being a distance of less than 0.5 mm from a surface of the second roller, so as to restrict a flow of water between the first semi-cylindrical channel and the first roller.

26. A device comprising:

at least two rollers, each roller of the at least two rollers being cylindrical;

a body to which the at least two rollers are attached, the body resting on the at least two rollers when the device rests on a flat level surface with the flat surface extending lengthwise under an entirety of the body, the at least two rollers supporting the body when the device moves on the at least two rollers, the body including at least one intake opening at the bottom of the body between the at least two rollers, the at least two rollers and the bottom of the body forming a path of water flow in which water flows from outside the device, to between the at least two rollers, into the intake opening;

at least one pump assembly being affixed inside the body for drawing water through the intake opening into the body and pushing the water out of the body;

a filter for filtering out debris in the water;

a power source for providing electrical power to the pump assembly; and wherein the at least two rollers are spaced so as, in combination with the pump, to create a vacuum a sufficient for picking up fine particles of debris from a pool floor, wherein the bottom of the body is spaced from each roller of the at least two rollers so that while the at least two rollers of the pool cleaner rest on one flat surface, resistance to water flow associated with paths of water flow that flow between any of the at least two rollers and the bottom of the body are greater than resistances to water flow associated with other paths of water flow that do not flow between the bottom of the body and the at least two rollers each of the at least two rollers being under the bottom of the device.

27. The device of claim 26, wherein the axles of the at least two rollers are parallel to each other.

28. The device of claim 26, wherein each of the at least one intake opening is located between two of the at least two rollers that are adjacent to each other, wherein the adjacent rollers and the bottom of the body form a path in which water flows from outside the device, to between the adjacent rollers, flowing into the intake opening between the adjacent rollers.

29. The device of claim 26, wherein the distance between the at least two rollers is less than half of a length of the body.

30. The device of claim 26, a surface of the bottom of the device being a distance of less than 5 mm from a surface of each of the at least two rollers, so as to restrict flow of water between the bottom of the device and the at least two rollers.

31. The device of claim 26, further comprising:

the bottom of the device having a plurality of partial-cylindrical channels, each channel of the plurality of channels housing one of the at least two rollers, each of the channels having a wall whose radius of curvature is larger than the radius of each roller housed within each of the channels, so that each of the roller turns freely within each of the channels, respectively.

32. The device of claim 26 further comprising:

the bottom of the device having a plurality of channels, each channel of the plurality of channels housing one of the at least two rollers, each of the channels having a wall whose radius of curvature is larger than the radius of each roller housed within each of the channels, so that each of the roller turns freely within each of the channels, respectively.

33. A device comprising at least two rollers, each roller of the at least two rollers being cylindrical;

a body to which the at least two rollers are attached, the body resting on only the at least two rollers when the device rests on entirely on one flat level surface, the at least two rollers supporting the body when the device moves on the at least two rollers, the body including at least one intake opening at the bottom of the body between the at least two rollers, the at least two rollers and the bottom of the body forming a path of water flow in which water flows from outside the device, to between the at least two rollers, into the intake opening;

at least one pump assembly being affixed inside the body for drawing water through the intake opening into the body and pushing the water out of the body;

a filter for filtering out debris in the water;

a power source for providing electrical power to the pump assembly; and the bottom of the device including at least a first channel, the first channel housing a first roller of the at least two rollers;

the first channel having a wall whose radius of curvature is larger than the radius of the first roller, so that the first roller turns freely within the first channel;

the first roller being located in the first channel so that the first channel is concentric to that first roller;

a second channel, the second channel housing a second roller of the at least two rollers;

the second channel having a wall whose radius of curvature is larger than the radius of the second roller, so that the second roller turns freely within the second channel; and the second roller being located in the second channel so that the second channel is concentric to that second roller.

34. The device of claim 33, wherein each of the at least one intake opening is located between two rollers of the at least two rollers and the intake opening is adjacent to each of the two rollers of the at least two rollers.

35. A device comprising:

at least two rollers;

a body to which the at least two rollers are attached, the body having a front end and a back end, the at least two rollers being oriented for traveling forwards and backwards, so that the front end faces forwards and the back end faces backwards when the device travels forwards, the body resting on the at least two rollers when the device rests on a flat level surface with the flat surface extending lengthwise under an entirety of the body, the at least two rollers supporting the body when the device moves on the at least two rollers, the body including at least one intake opening at the bottom of the body between the at least two rollers, while the device rests on a flat level surface, the body is completely supported by only rollers that are each closer to an intake opening than (1) to the back of the device and (2) to the front of the device; the at least two rollers and the bottom of the body forming a channel region for water to flow from outside the device, to between two rollers of the at least two rollers, one of the at least two rollers being on one side of the intake opening at a location that is closer to the intake opening than to the front end and back end of the body, and another of the two rollers of the at least two rollers being on another side of the intake opening, at a location that is closer to the intake opening than to the front end and back end of the body, so that water passing into the intake opening passes between the two of the at least two rollers;

at least one pump assembly being affixed inside the body for drawing water through the intake opening into the body and pushing the water out of the body;

a filter for filtering out debris in the water;

a power source for providing electrical power to the pump assembly.

36. The device of claim 35, device having a top surface and a bottom surface, the bottom surface having the intake opening, and the top surface being a surface that is opposite the bottom surface that is furthest away from the bottom surface, the pump being attached to the top surface of the body, the pump having a center, the center of the pump being closer to the top surface than the bottom surface.

37. A device comprising:

at least two rollers;

a body to which the at least two rollers are attached, the body resting on the at least two rollers when the device rests on a flat level surface, the at least two rollers supporting the body when the device moves on the at least two rollers, the body including at least one intake opening at the bottom of the body between the at least two rollers, the at least two rollers and the bottom of the body forming a path of water flow in which water flows from outside the device, to between the at least two rollers into the intake opening;

at least one pump assembly being affixed inside the body for drawing water through the intake opening into the body and pushing the water out of the body;

a filter for filtering out debris in the water;

a power source for providing electrical power to the pump assembly;

a plurality of wheels rotatably attached to the body of the device, each wheel having a bottom, each roller of the at least two rollers having a bottom, the body having a bottom, the plurality of wheels are attached to the body in a location that holds the bottoms of the plurality of wheels closer to the bottom of the body than the bottoms of the at least two rollers are to the bottom of the body;

wherein the plurality of wheels are located further away from the intake opening than the at least two rollers.

* * * * *